United States Patent [19]

Kuse et al.

[11] Patent Number: 4,774,169

[45] Date of Patent: Sep. 27, 1988

[54] PROCESSING SOLUTION FOR DEVELOPING A SILVER HALIDE COLOR PHOTOGRAPHIC MATERIAL AND A METHOD OF DEVELOPING THE SAME

[75] Inventors: Satoru Kuse, Hino; Shigeharu Koboshi, Sagamihara; Masahiko Kon, Hino, all of Japan

[73] Assignee: Konishiroku Photo Industry Co., Ltd., Tokyo, Japan

[21] Appl. No.: 892,279

[22] Filed: Aug. 4, 1986

[30] Foreign Application Priority Data

| | | | |
|---|---|---|---|
| Aug. 6, 1985 | [JP] | Japan | 60-172962 |
| Aug. 15, 1985 | [JP] | Japan | 60-179833 |
| Aug. 16, 1985 | [JP] | Japan | 60-180084 |
| Oct. 31, 1985 | [JP] | Japan | 60-245589 |

[51] Int. Cl.[4] ..... G03C 5/24; G03C 7/32; G03C 7/34; G03C 5/42

[52] U.S. Cl. ..... 430/467; 430/372; 430/376; 430/383; 430/384; 430/385; 430/393; 430/399; 430/432; 430/461; 430/491; 430/493

[58] Field of Search ..... 430/432, 461, 372, 376, 430/421, 585, 588, 467, 383, 384, 393, 399

[56] References Cited

U.S. PATENT DOCUMENTS

| | | | |
|---|---|---|---|
| 2,913,338 | 11/1959 | Bates et al. | 430/372 |
| 4,385,110 | 5/1983 | Yoneyama et al. | 430/372 |
| 4,555,481 | 11/1985 | Ukai et al. | 430/588 X |
| 4,555,482 | 11/1985 | Inoue et al. | 430/574 |
| 4,562,144 | 12/1985 | Kurematsu et al. | 430/372 |

FOREIGN PATENT DOCUMENTS 669505 4/1952 United Kingdom .

*Primary Examiner*—Mukund J. Shah

*Attorney, Agent, or Firm*—Finnegan, Henderson, Farabow, Garrett & Dunner

[57] ABSTRACT

A processing solution for developing a silver halide color photographic material. The material has a color developing agent and at least one compound selected from the group consisting of an aminocarboxylic acid and an aminophosphonic acid. The processing development solution has a surface tension ranging from 20 to 60 dynes/cm.

18 Claims, No Drawings

PROCESSING SOLUTION FOR DEVELOPING A SILVER HALIDE COLOR PHOTOGRAPHIC MATERIAL AND A METHOD OF DEVELOPING THE SAME

FIELD OF THE INVENTION

This invention relates to a processing solution for developing a silver halide color photographic material. This invention particularly relates to a processing solution for development, which is free from deposition of a color developing agent in a replenisher tank and pipes of an automatic developing machine at cold districts or under cold weather, and crystal deposition caused by evapolation at the solution boundary in the replenisher tank arising when the replenishing solution is stored for long periods in the replenisher tank at hot or dry districts such as tropics or deserts, and which is usable over a wide variety of districts in the world and exhibits consistent processing characteristics. This invention also relates to a color development processing method for a silver halide color photographic material, and more particularly to a novel color development processing method which is free from generation of stains at an unexposed section and particularly improves apparent whiteness, and which is free from difference in photographic characteristics caused by differences in processing solutions stirring capacity between automatic developing machines and provides consistent photographic characteristics regardless of the types of automatic developing machines.

BACKGROUND OF THE INVENTION

Basically, the processing of photographic materials comprises a color development process and a desilvering process. The desilvering process comprises a bleaching process and a fixing process or a bleaching and fixing process. The processing of photographic materials also comprises additional processes such as rinsing and stabilization.

In the color development, exposed silver halide is reduced into silver, and at the same time an oxidized aromatic primary amine developing agent reacts with a coupler to form a dye. During this stage, halogen ions generated by a reduction field of silver halide dissolve and accumulate in the developing solution. Also, constituents such as a development restrainer contained in the silver halide photographic material dissolve and accumulate in the color developing solution. In the desilvering process, silver generated by development is bleached by an oxidizing agent, and then all silver salts are removed by the fixing agent as soluble silver salts from the photographic material. There has heretofore been known also the combined bleach-fixing method in which bleaching and fixing are carried out simultaneously in one bath.

As described above, in the color developing solution, the development restrainer accumulates by the development processing of the photographic material. On the other hand, the color developing agent and benzyl alcohol are consumed, or accumulated in the photographic material and removed from the color developing solution. Thus the concentrations of these constituents decrease. Therefore, in the development processing method wherein large amounts of silver halide photographic materials are continuously processed in an automatic developing machine or the like, it is necessary to provide a means for maintaining the concentrations of constituents of the color developing solution within a predetermined range for eliminating changes in development finish characteristics caused by changes in concentrations of the constituents. Normally, as such means, a method wherein a replenishing solution for replenishing the insufficient constituents and diluting the unnecessary increasing constituents is added is used. However, this method has the economical and pollution drawbacks since a large amount of overflow which must be discarded arises when the replenishing solution is added. Accordingly, in recent years, in order to decrease the amount of overflow, it has been proposed to use a developing solution regeneration method using an ion exchange resin or electrodialysis, a method of adding small amounts of concentrated replenishing solution, or a method wherein a regeneration agent is added to the overflow solution for using the overflow solution as the replenishing solution.

Regeneration of the developing solution is carried out by removing bromide which is an unnecessary accumulated constituent and replenishing the insufficient constituents. However, these methods, i.e. the method using an ion exchange resin and the method using electrodialysis, have the drawback that the development processing characteristics for the photographic material are adversely affected unless the constituents of the developing solution are quantitatively determined by chemical analysis and their quantities are made constant. Thus these methods require complicated control, and therefore it is almost impossible for small-scale development stations or mini labs. having no particularly skill to introduce the methods. Further, with these methods, the initial cost is very high.

Further, with the method in which a regenerating agent is added to the overflow solution for using it as a replenishing solution, no particular skill is required. However, with this method, spaces for a stock tank or the like are necessary. Also, the method is troublesome for the development stations. Therefore, it is difficult for the mini labs. or the like to introduce the method. On the other hand, the method of low replenishment with concentrated replenishing solution does not require a new apparatus and is easy to conduct processing control. Therefore, this method would be suitable for small-scale laboratories such as so-called mini lab. However, this method has some drawbacks. For example, when a p-phenylenediamine derivative is used as the color developing agent in a developing solution which is alkaline, particularly, which has a pH value of 9 or higher, an amine base or free amine readily deposits in the replenisher tank or pipes (particularly where soft polyvinyl chloride hoses are used) at cold districts or under cold weather. Also, as color printing propagates in recent years, the color development processing is carried out at various districts in the world. For example, in laboratories at hot or dry districts such as tropics or deserts, crystals arise at the boundary between the tank and the replenishing solution due to evaporation from the replenisher tank.

As the technique for increasing the solubility of the p-phenylenediamine derivative in the developing solution and thereby eliminating the aforesaid drawback, there have heretofore been known to add alkylbenzenesulfonic acid as described in British Pat. No. 669,505, to add methyl cellulose as described in Japanese Patent Publication No. 46-41676, to add lactose or hydroxypropyl cellulose as disclosed in Japanese Patent Publication No. 50-21250, and to add a carboxylic acid derivative or a quaternary ammonium compound having hydroxyalkyl group as disclosed in Japanese Unexamined Patent Publication Nos. 53-70436 and 53-69035.

However, these techniques of adding the above-mentioned compounds to the developing solution have various drawbacks and are not satisfactory in practice. Specifically, alkylbenzenesulfonic acid must be added in a large amount on the order of 100 to 200 g/l. Cellulose can improve the solubility of p-phenylenediamine derivative in the developing solution with the addition of a relatively small amount. However, for example, methyl cellulose or the like decreases the solubility when it is added in an amount larger than a predetermined amount to the developing solution. Further, when the processing solution is provided as a kit, since the solubility of the additive is markedly low, long time and particular devices are necessary for production of the processing agent kit. Also, the effect of the carboxylic acid and quaternary ammonium compound on prevention of crystal deposition at the evaporation surface is small. Further, in the color development processing bath, the constituents dissolved from the silver halide color photographic material accumulate to a high concentration. As a result, stains arise at an unexposed sections, and apparent whiteness is deteriorated.

The number of mini labs. has increased rapidly in recent years. For example, the number of the mini labs. present as of May 1985 in Japan is approximately 3,000, and at least one third thereof is said to have been built in the past one year. Thus the mini labs. became very popular. In the mini labs., only several workers are present normally. For example, besides selling cameras and films, the workers are engaged in printing service. Therefore, the workers are very busy and short-handed. In the case where the apparatus runs out of the replenishing solution when the workers are very busy, they must stop printing work and perform dissolving work for the replenishing solution. Since the concentration of the replenishing solution for color development has been increased in recent years, it takes long time for dissolving work. Therefore, in the mini labs., it is strongly desired that the dissolving work for the replenishing solution may be achieved easily and as quick as possible even though the concentration of the replenishing solution is high. Also, as mentioned above, as low replenishment of concentrated replenishing solution for color developing solution is increasingly employed in recent years, the pH value of the replenishing solution is adjusted to an increasingly high value in order to maintain the pH condition of the color development processing bath with low amount replenishment. However, it is not always possible to maintain the high pH value. Thus there is also a need for solving this problem. Further, under the aforesaid situation wherein the mini labs. became popular, it is strongly desired to develop a method of processing the silver halide color photographic material, which provides consistent photographic performance regardless of the type of the automatic developing machine. As mentioned above, as low replenishment with concentrated replenishing solution for color developing solution is increasingly employed in recent years, it is also strongly desired to minimize deterioration of whiteness of the unexposed sections even with addition of small amounts of the replenishing solution.

SUMMARY OF THE INVENTION

The primary object of the present invention is to provide a processing solution for developing a silver halide color photographic material, which is free from amine crystal deposition in a tank or pipes even at cold districts and under cold weather.

Another object of the present invention is to provide a processing solution for developing a silver halide color photographic material, which is free from crystal deposition due to amine caused by evaporation at the solution boundary in a replenisher tank even when the replenishing solution is stored for long time at hot or dry districts such as tropics and deserts.

A further object of the present invention is to provide a processing solution for developing a silver halide color photographic material, which is quickly prepared by dissolution.

A still further object of the present invention is to provide a processing solution for developing a silver halide color photographic material, which realizes maintaining of a high pH value.

The specific object of the present invention is to provide a method of processing a silver halide color photographic material, which is free from generation of stains at unexposed sections.

Another object of the present invention is to provide an improved method of processing a silver halide color photographic material, which provides consistent photographic performance regardless of differences in stirring capacity between automatic developing machines.

Other objects of the present invention will be clear from the following descriptions.

In order to accomplish the aforesaid objects, the inventors conducted various experiments, and found that the aforesaid objects are accomplished by a processing solution for color development which contains at least one compound selected from the group consisting of aminocarboxylic acid compounds and aminophosphonic acid compounds and which have a surface tension within the range of 20 to 60 dyne/cm, and a method of processing a silver halide color photographic material by use of the processing solution for color development.

DETAILED DESCRIPTION OF THE INVENTION

In other words, the inventors conducted various experiments for accomplishing the aforesaid objects, and found that the objects of the present cannot be accomplished when only an aminocarboxylic acid compound or an aminophosphonic acid compound is used in a processing solution for color development such as a color developing solution or a color development replenishing solution (both of these solutions are hereinafter referred to as the processing solution for color development), or when only the surface tension of the processing solution is adjusted to 20 to 60 dyne/cm. Thus it was unexpectedly found that the objects of the present invention can be accomplished only when these two requirements, i.e. the use of an aminocarboxylic acid compound or an aminophosphonic acid compound and adjustment of the surface tension to the aforesaid range, are satisfied. The present invention was made based on these findings.

The surface tension of the processing solution in accordance with the present invention is measured by a general measuring method described, for example, in Fumio Kitahara, et al. "Analysis and Test Method for Surface Active Agent", Mar. 1, 1982, Kodansha, Japan. It is the surface tension value as measured by the ordinary measuring method at 20° C.

In the present invention, adjustment of the surface tension of the processing solution to the range of 20 to 60 dyne/cm may be conducted by any method, and is preferably be conducted by use of a surface active agent. When the surface tension is smaller than 20 dyne/cm, foaming arises to a large extent during dissolution for the processing solution. When it is larger than 60 dyne/cm, the effects of the present invention cannot be obtained. Therefore, in the present invention, the surface tension is adjusted within the range of 20 to 60 dyne/cm. Better effects of the present invention are obtained particularly when the surface tension of the processing solution is within the range of 25 to 42 dyne/cm.

The aminocarboxylic acid compound and the aminophosphonic acid compound used in the present invention respectively represent an amino compound having at least two carboxylic acid groups and an amino compound having at least two phosphonic acid groups. They are preferably be represented by the general formula [VIII] and [IX]:

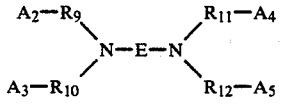

[VIII]

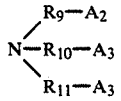

[IX]

wherein E is selected from the group consisting of an alkylene group, a cycloalkylene group and a phenylene group, in which respective groups may be substituted, $—R_{13}OR_{13}OR_{13}—$, $—R_{13}ZR_{13}—$ (wherein Z represents $>N—R_{13}—A_6$ or $>N—A_6$); $R_9$ to $R_{13}$ independently represent an alkylene group which may be substituted; $A_2$ to $A_6$ are independently selected from the group consisting of a hydrogen atom, —OH, —COOM, and $—PO_3M$, wherein M is a hydrogen atom or an alkali metal atom, provided that at least two of $A_2$ to $A_6$ are selected from —COOM and $—PO_3M$.

Preferred examples of the compounds represented by the general formulas [VIII] and [IX] are shown below.

[Examples of compounds]

[VIII-1] Ethylenediamine tetraacetic acid
[VIII-2] Diethylenetriamine pentaacetic acid
[VIII-3] Ethylenediamine-N-(β-hydroxyethyl)-N,N',N'-triacetic acid
[VIII-4] Propylenediamine tetraacetic acid
[VIII-5] Triethylenetetramine hexaacetic acid
[VIII-6] Cyclohexanediamine tetraacetic acid
[VIII-7] 1,2-Diaminopropane tetraacetic acid
[VIII-8] 1,3-Diaminopropane-2-ol-tetraacetic acid
[VIII-9] Ethyletherdiamine tetraacetic acid
[VIII-10] Glycoletherdiamine tetraacetic acid
[VIII-11] Ethylenediamine tetrapropionic acid
[VIII-12] Phenylenediamine tetraacetic acid
[VIII-13] Ethylenediamine tetraacetic acid disodium salt
[VIII-14] Ethylenediamine tetraacetic acid tetra(-trimethyl ammonium) salt
[VIII-15] Ethylenediamine tetraacetic acid tetrasodium salt
[VIII-16] Diethylenetriamine pentaacetic acid pentasodium salt
[VIII-17] Ethylenediamine-N-(β-hydroxyethyl)-N,N',N'-triacetic acid sodium salt
[VIII-18] Propylenediamine tetraacetic acid sodium salt
[VIII-19] Ethylenediamine tetramethylene phosphonic acid
[VIII-20] Cyclohexanediamine tetraacetic acid sodium salt
[VIII-21] Diethylenetriamine pentamethylene phosphonic acid
[VIII-22] Cyclohexanediamine tetramethylene phosphonic acid
[IX-1] Nitrilotriacetic acid
[IX-2] Iminodiacetic acid
[IX-3] Hydroxyethyliminodiacetic acid
[IX-4] Nitrilotriprpionic acid
[IX-5] Nitrotrimethylenephosphonic acid
[IX-6] Iminodimethylenephosphonic acid
[IX-7] Hydroxyethyliminodimethylenephosphonic acid
[IX-8] Nitrilotriacetic acid trisodium salt Among the above enumerated aminocarboxylic acid compounds and aminophosphonic acid compounds, [VIII-1], [VIII-2], [VIII-5], [VIII-8], [VIII-19], [IX-1], [IX-3], and [IX-5] are particularly preferable from the viewpoint of the effects of the present invention.

The addition amount of the aminocarboxylic acid compound and/or the aminophosphonic acid compound should preferably be within the range of 0.1 g to 20 g per liter of the processing solution, more preferably be within the range of 0.3 g to 5 g per liter of the processing solution.

In the present invention, the term "substantially free from a bromide compound" means that the amount of the bromide compound contained in the processing solution is $2\times10^{-3}$ mol/l or less.

In the processing solution of the present invention, a p-phenylenediamine color developing agent is used. The color developing agent is used, in general, in the form of a salt, for example, a hydrochloride or a sulfate since this form is more stable than the free form. The p-phenylenediamine color developing agent is generally used in a proportion within the range of approximately 0.5 g to approximately 30 g per liter of the processing solution.

In the prelsent invention, a particularly preferable p-phenylenediamine color developing agent is an aromatic primary amine color developing agent having at least one water-soluble amino group. The compound represented by the general formula [X] is particularly preferable.

[X]

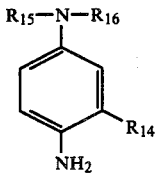

wherein $R_{14}$ is selected from the group consisting of a hydrogen atom, a halogen atom and a straight chain or branched alkyl group having 1 to 5 carbon atoms, in which the alkyl group may be substituted; $R_{15}$ and $R_{16}$ are respectively selected from the group consisting of a hydrogen atom, an alkyl group and an aryl group in which these groups may be substituted, and the alkyl group should preferably be substituted by an aryl group, and at least one of $R_{15}$ and $R_{16}$ is an alkyl group substituted by a water-soluble group selected from the group consisting of a hydroxyl group, a carboxylic acid group, a sulfonic acid group, an amino group and a sulfonamide group, in which the alkyl group may further be substituted, or at least one of $R_{15}$ and $R_{16}$ is $\text{-}((CH_2)_t O)_r R_{17}$ wherein $R_{17}$ represents a hydrogen atom or a straight chain or branched alkyl group having 1 to 5 carbon atoms, and t and r respectively denote an integer of 1 to 5.

Nonlimitative examples of the compound represented by the general formula [X] are shown below.

[Examples of compound]

(E-1)

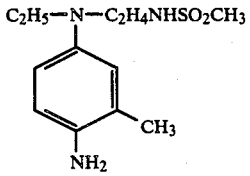

(E-2)

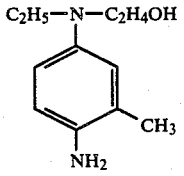

-continued (E-3)

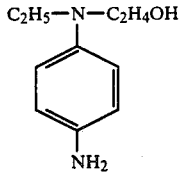

(E-4)

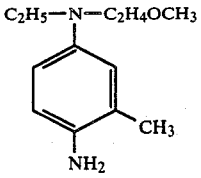

(E-5)

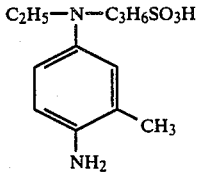

(E-6)

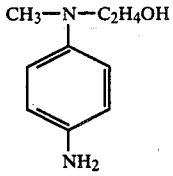

(E-7)

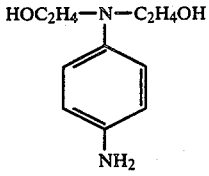

(E-8)

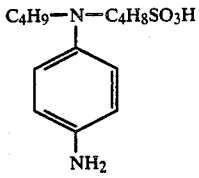

(E-9)

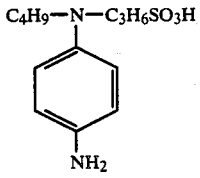

(E-10)

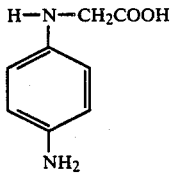

-continued (E-11)

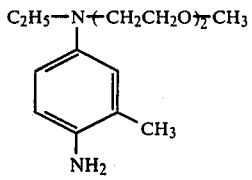

(E-12)

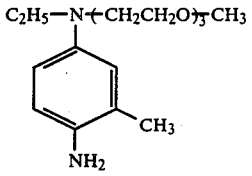

(E-13)

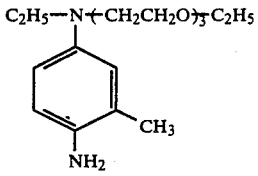

(E-14)

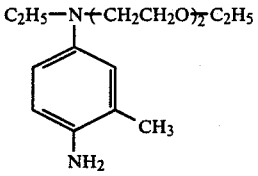

(E-15)

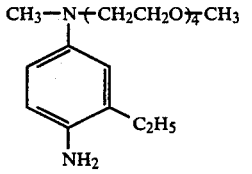

(E-16)

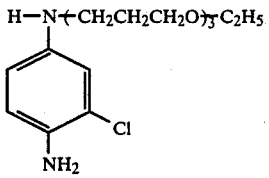

The p-phenylenediamine derivatives represented by the general formula [X] may be used in the form of an organic acid salt or an inorganic acid salt, for example, as a hydrochloride, a sulfate, a phosphate, a p-toluene sulfonate, a sulfite, an oxalate, or a benzenedisulfonate. Among these p-phenylenediamine derivatives represented by the general formula [X], the derivatives in which $R_{15}$ and/or $R_{16}$ is $-(CH_2)_t O)_r R_{17}$ in which t, r annd $R_{17}$ have the same meanings as described above are particularly preferable in the present invention.

In an preferred embodiment of the present invention, the processing solution contains a compound represented by the general formula [I]:

$$RO-(A)_n(B)_m C \qquad (I)$$

wherein R is selected from the group consisting of a straight chain or branched alkyl group having 4 to 25 carbon atoms, which may be substituted, and a group of the formula

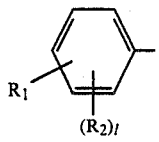

in which $R_1$ and $R_2$ are independently selected from the group consisting of a hydrogen atom and an alkyl group having 1 to 20 carbon atoms, which may be substituted, l is an integer of 1 to 4 provided that when l is 2, 3 or 4 $R_2$'s may be either the same or different: A and B independently represent a group represented by the formula $$-(CH_2)_{n1}-(\underset{\underset{OH}{|}}{CH})_{m1}-(CH_2)_{l1}O-$$

or different, in which $n_1$, $m_1$ and $l_1$ independently denote an integer of 0, 1, 2 or 3; C is selected from the group consisting of a hydrogen atom and a group represented by $-SO_3M$, wherein M is selected from the group consisting of a hydrogen atom, sodium, potassium, ammonium and lithium; and n and m are independently an integer of 0 to 25 provided that m and n are not 0 at the same time.

Further, the processing solution may contain at least one of the compounds represented by the general formulas [II] to [V]:

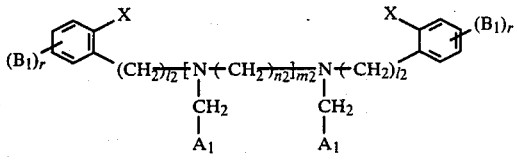

[II]

wherein $A_1$ is selected from the group consisting of a carboxylic acid group or a salt thereof and a phosphoric acid or a salt thereof; X is a hydroxyl group or a salt thereof; $B_1$ is selected from the group consisting of a halogen atom, a hydroxyl group or a salt thereof, an alkyl group, a carboxylic acid group or a salt thereof, phosphonic acid group or a salt thereof; r and $l_2$ independently represent an integer of 0, 1 or 2; $n_2$ represents an integer of 1 to 4; and $m_2$ represents an integer of 0 to 3 provided that $l_2+m_2+n_2 \neq 0$.

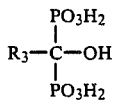

[III]

wherein $R_3$ represents an alkyl group having 1 to 5 carbon atoms, which may be substituted, or an amino group.

[IV]

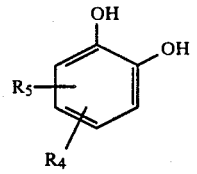

[V]

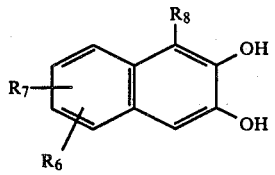

wherein $R_4$, $R_5$, $R_6$, $R_7$ and $R_8$ are independently selected from the group consisting of a hydrogen atom, a halogen atom, a sulphonic acid group, a substituted or unsubstituted alkyl group having 1 to 7 carbon atoms, a substituted or unsubstituted phenyl group, $-OR_9$, $-COOR_{10}$, and

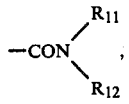

wherein $R_9$, $R_{10}$, $R_{11}$ and $R_{12}$ are independently selected from the group consisting of a hydrogen atom and an alkyl group having 1 to 18 carbon atoms.

In a further preferred embodiment of the present invention, the processing solution contains a compound represented by the general formula [VI] or [VII]:

$$HO\text{-}(A)_{n_3}(B)_{m_3}H \quad [VI]$$

$$N\text{-}[(A)_n(B)_mH]_3 \quad [VII]$$

wheren n, m, A and B have the same meanings as in the general formula [I], and $n_3$ and $m_3$ independently denote an integer of 0 to 600 provided that $n_3$ and $m_3$ are not 0 at the same time.

The processing solution in accordance with the present invention may contain bromide ions. In this case, the amount of the bromide ion contained should preferably be $0.7\times10^{-2}$ to $3.5\times10^{-2}$ per liter of the processing solution.

The bromide ions may be added to the processing solution in the form of an alkali metal salt such as sodium bromide, potassium bromide, or lithium bromide, or may be fed from silver halide in the photographic material which is processed.

In the present invention, particularly good effects are obtained when the compound represented by the general formula [I] is used as the surface active agent for controlling the surface tension.

Preferred examples of the compound represented by the general formula [I] are shown below.

[Examples of compounds]

(I-1)

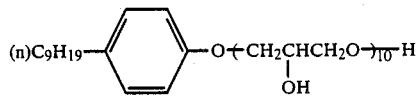

(I-2)

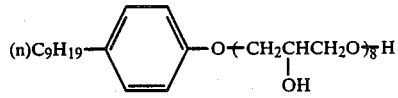

(I-3)

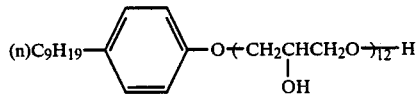

(I-4)

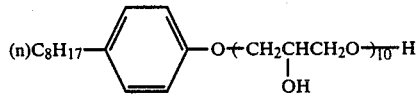

(I-5)

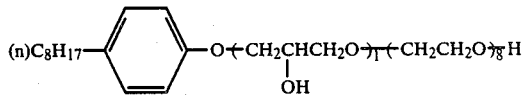

(I-6)

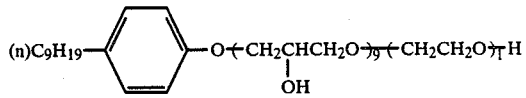

(I-7)

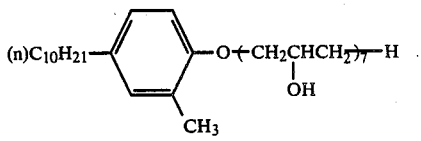

(I-8)

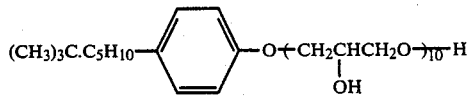

(I-9)

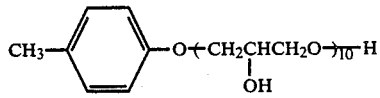

(I-10)

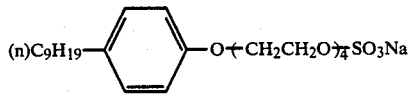

(I-11)

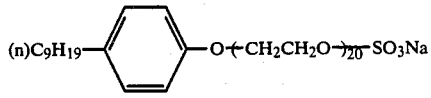

$(n)C_{13}H_{27}-O\text{-}(CH_2CH_2O)_{15}SO_3Na$ (I-12)

$(n)C_{12}H_{25}-O\text{-}(CH_2CH_2O)_{13}SO_3Na$ (I-13)

$(n)C_{10}H_{21}-O\text{-}(CH_2CH_2O)_{14}SO_3K$ (I-14)

$(n)C_{16}H_{33}-O\text{-}(CH_2CH_2O)_{14}SO_3Na$ (I-15)

$(n)C_{12}H_{25}-O\text{-}(CH_2CH(OH)CH_2O)_{10}H$ (I-16)

-continued

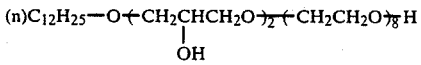

(I-17)

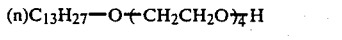

(I-18)

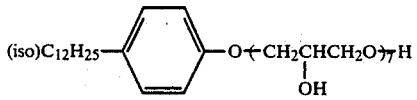

(I-19)

Among these compounds represented by the general formula [I], (I-1), (I-12) and (I-13) are particularly preferable for the objects of the present invention.

These compounds are prepared by a general synthetic method as described in British Pat. No. 1,022,878, U.S. Pat. Nos. 3,723,341 and 3,437,598. Or, they are available commercially (for example, they are supplied by Olin Mathieson Chemical Corp., etc.).

The compound represented by the general formula [I] should preferably be used in a proportion within the range of 0.001 g to 10 g per liter of the processing solution in accordance with the present invention, more preferably in a proportion within the range of 0.001 g to 3 g per liter of the processing solution.

Preferred examples of the compound represented by the general formula [II] are shown below.

[Examples of compounds]

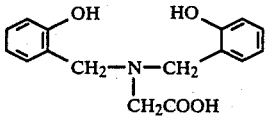

(II-1)

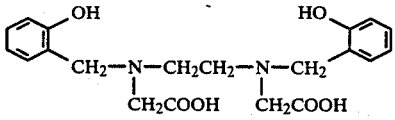

(II-2)

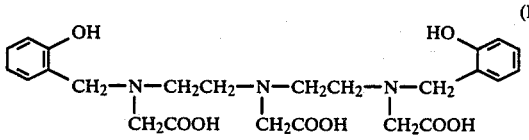

(II-3)

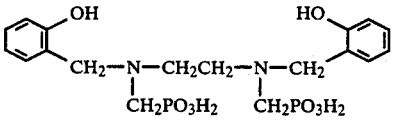

(II-4)

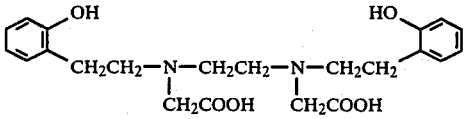

(II-5)

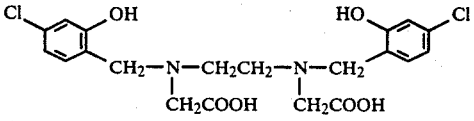

(II-6)

-continued

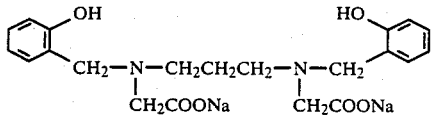

(II-7)

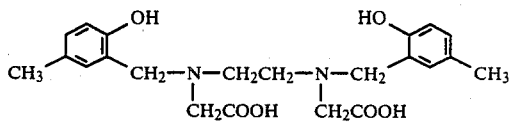

(II-8)

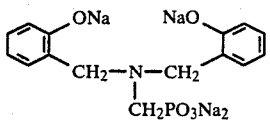

(II-9)

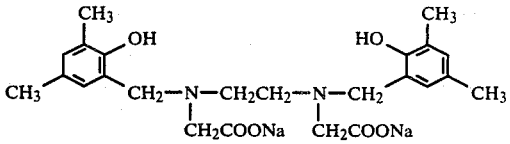

(II-10)

These compounds are prepared by a general synthetic method as described in U.S. Pat. No. 3,632,637 and Journal Of The American Chemical Society, Vol. 89 (1967), Page 387.

Preferred examples of compound represented by the general formula [III] are shown below.

(III-1) 1-hydroxyethylidene-1,1-diphosphonic acid
(III-2) 1-hydroxypropylidene-1,1-diphosphonic acid
(III-3) 1,2-dihydroxyethane-1,1-diphosphonic acid
(III-4) 1-hydroxybutane-1,1-diphosphonic acid
(III-5) 1-hydroxy-2-carboxy-ethane-1,1-diphosphonic acid
(III-6) 1-amino-ethylidene-1,1-diphosphonic acid Examples of the compounds represented by the general formulas [IV] and [V] are 1,2-dihydroxybenzene, 4-isopropyl-1,2-dihydroxybenzene, 1,2-dihydroxybenzene-3, 5-disulfonic acid, 1,2,3-trihydroxybenzene, 1,2,3-trihydroxybenzene-5-carboxylic acid, 1,2,3-trihydroxybenzene-5-carboxymethyl ester, 1,2,3-trihydroxybenzene-5-carboxy-n-butyl ester, 5-t-butyl-1,2,3-trihydroxybenzene, 2,3-dihydroxynaphthalene-6-sulfonic acid, and 2,3,8-trihydroxynaphthalene-6-sulfonic acid. However, the aforesaid compounds are not limited to these ones. Among the above enumerated compounds, 1,2-dihydroxybenzene-3, 5-disulfonic acid and a sodium salt or a potassium salt thereof, compounds (III-1), (II-2) and (II-10) are preferably used in the present invention, and 1,2-dihydroxybenzene-3, 5-disulfonic acid and its salts (sodium salt, potassium salt) are particularly preferable.

The compounds represented by the general formulas [II] to [V] are preferably used in a proportion within the range of 0.01 g to 10 g per liter of the processing solution of the present invention, more preferably in a proportion within the range of 0.01 g to 3 g per liter of the processing solution.

Examples of the compounds represented by the general formulas [VI] and [VII] and preferably used in the present invention are shown below.

[Examples of compounds]

$HO-CH_2CH_2-OH$ (VI-1)

$HO\text{-}(CH_2CH_2O)_2\text{-}H$ (VI-2)

$HO\text{-}(CH_2CH_2O)_3\text{-}H$ (VI-3)

$HO\text{-}(CH_2\underset{\underset{OH}{|}}{C}HCH_2O)_2\text{-}(CH_2CH_2O)\text{-}OH$ (VI-4)

$HO\text{-}(CH_2CH_2O)_{10}\text{-}H$ (VI-5)

$HO\text{-}(CH_2CH_2O)_{35}\text{-}H$ (VI-6)

$HO\text{-}(CH_2CH_2O)_{78}\text{-}H$ (VI-7)

$HO\text{-}(CH_2CH_2CH_2O)_{72}\text{-}H$ (VI-8)

$HO\text{-}(CH_2CH_2CH_2O)\text{-}H$ (VI-9)

$HO-CH_2CH_2CH_2CH_2-OH$ (VI-10)

$HO\text{-}(CH_2)_5\text{-}OH$ (VI-11)

$HO\text{-}(CH_2CH_2O)_{492}\text{-}H$ (VI-12)

$HO\text{-}(CH_2\underset{\underset{OH}{|}}{C}HCH_2O)_4\text{-}H$ (VI-13)

$N\text{-}(CH_2CHOH)_3$ (VII-1)

$N\text{-}[(CH_2CH_2O)_2\text{-}H]_3$ (VII-2)

$N\text{-}[(CH_2\underset{\underset{OH}{|}}{C}HCH_2O)_2\text{-}H]_3$ (VII-3)

$N\text{-}(CH_2\underset{\underset{OH}{|}}{C}HCH_2OH)_3$ (VII-4)

$N\text{-}(CH_2CH_2CH_2OH)_3$ (VII-5)

$N\text{-}(CH_2CH_2CH_2CH_2OH)_3$ (VII-6)

Among these compounds represents by the general formulas [VI] and [VII], (VI-1), (VI-2) and (VII-1) are the particularly preferable for present invention.

The compounds represented by the general formulas [VI] and [VII] should preferably be used in a proportion within the range of 0.3 g to 50 g per liter of the processing solution in accordance with the present invention, more preferably within the range of 1 g to 20 g per liter of the procesing solution.

A triazil stilbene fluorescent whitening agent is preferably used in the processing solution of the present invention since the effects of the present invention are well accomplished, and a different effect of improving the tar characteristics during storage of the processing solution is also obtained.

The triazil stilbene fluorescent whitening agent used in the present invention should preferably be the one represented by the following general formula [XI]:

[XI]

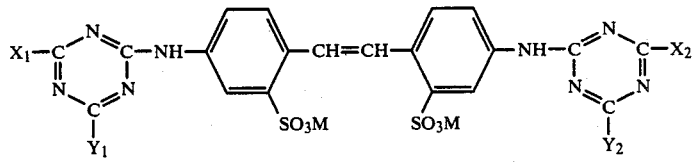

wherein $X_1$, $X_2$, $Y_1$ and $Y_2$ are independently selected from the group consisting of a hydroxyl group, a halogen atom such as chlorine or bromine, a morpholino group, an alkoxy group (for example, methoxy, ethoxy, or methoxyethoxy), an aryloxy group (for example, phenoxy, or p-sulfophenoxy), and alkyl group (for example, methyl, or ethyl), an aryl group (for example, phenyl, or methoxyphenyl), an amino group, an alkylamono group (for example, methylamino, ethylamino, propylamino, dimethylamino, cyclohexylamino, β-hydroxyethylamino, di(β-hydroxyethyl-)amino, β-sulfoethylamino, N-(β-sulfoethyl)-N'-methylamino, or N-(β-hydreoxyethyl-N'-methylamino), and an arylamino group (for example, anilino, o-, m- or p-sulfoanilino, o-, m- or p-chloroanilino, o-, m- or p-toluidino, o-, m- or p-carboxyanilino, o-, m- or p-hydroxyanilino, sulfonaphthylamino, o-, m- or p-aminoanilino, o-, m- or p-anidino); and M has the same meaning as in the general formula [I].

Nonlimitative examples of the fluorescent whitening agent are shown below.

[Examples of compound]

(A-1)

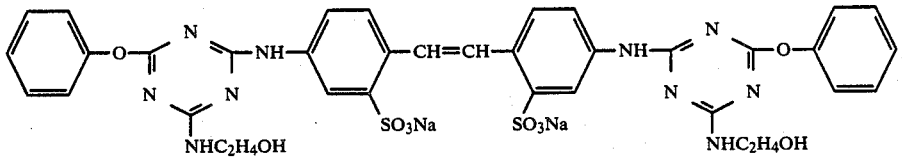

(A-2)

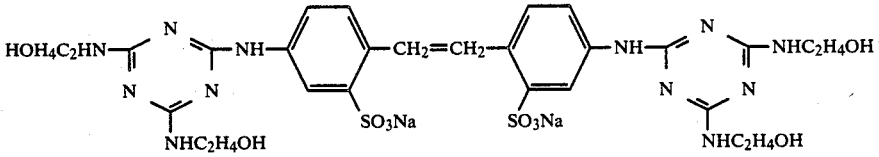

-continued
(A-3)
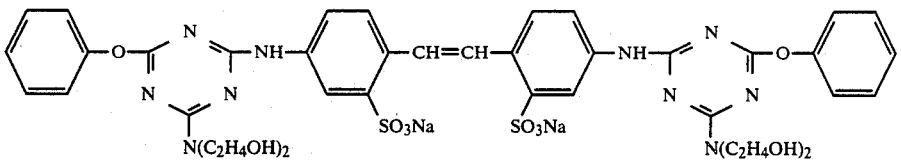
(A-4)
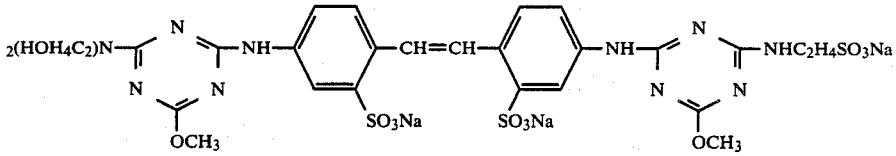
(A-5)
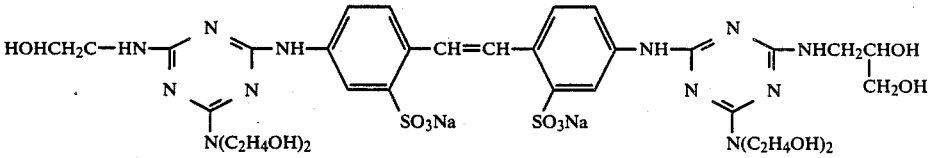
(A-6)
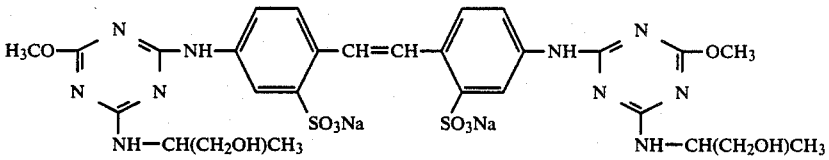
(A-7)
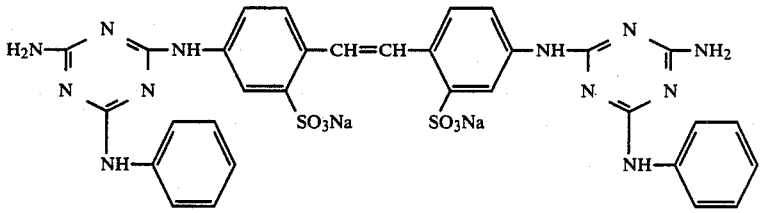
(A-8)
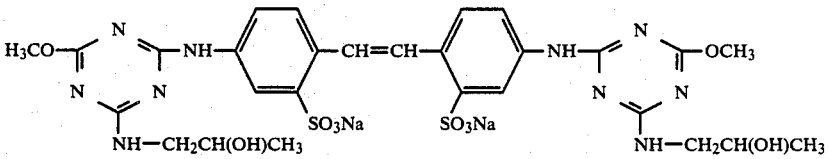
(A-9)
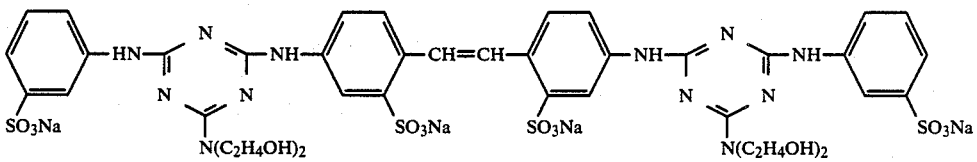
(A-10)
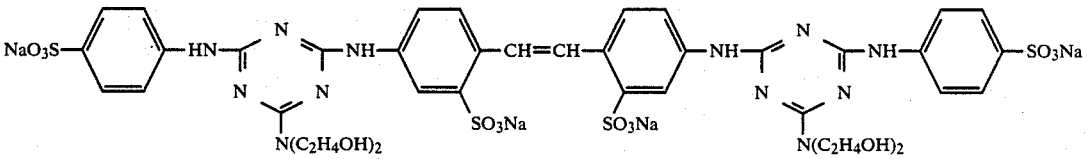

-continued (A-11)

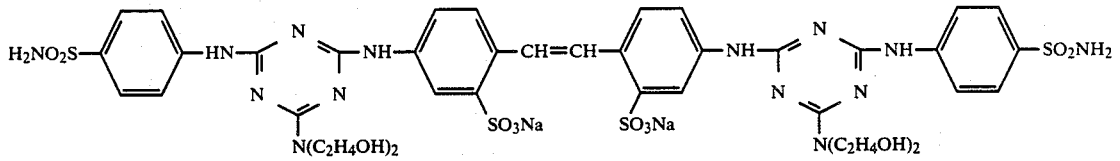

(A-12)

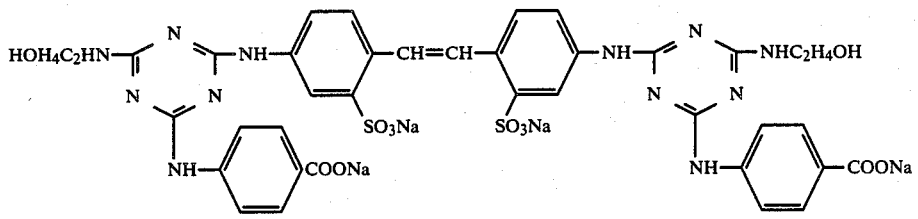

(A-13)

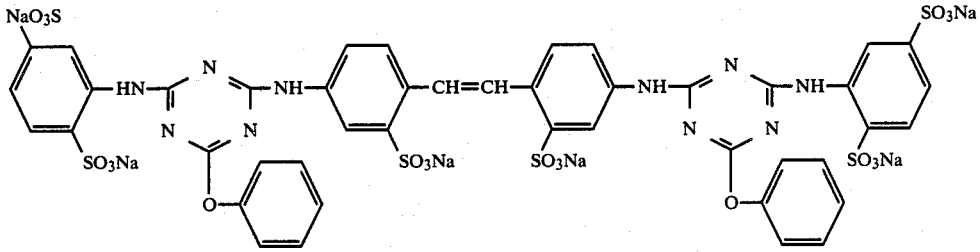

(A-14)

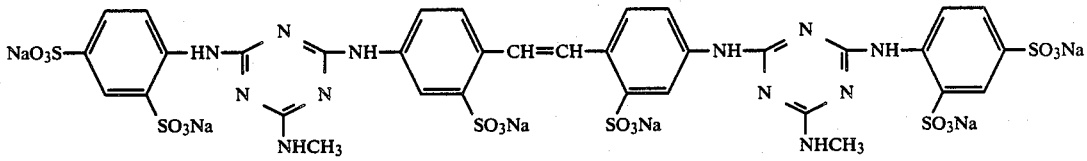

The triazil stilbene fluorescent whitening agents used in the present invention may be synthesized by the ordinary method described, for example, in "Fluorescent Whitening Agent", Kaseihin Kogyo Kyokai, August (1976), page 8.

The triazil stilbene fluorescent whitening agents are used preferably in a proportion within the range of 0.2 g to 6 g per liter of the processing solution in accordance with the present invention, more preferably in a proportion within the range of 0.4 g to 3 g per liter of the processing solution.

In addition to the aforesaid sequestering agent, other sequestering agents such as polyphosphoric acid, oxycarboxylic acid, and phosphonocarboxylic acid may further be added.

The processing solution in accordance with the present invention may contain alkali agents which are normally used in developing solutions, such as sodium hydroxide, potassium hydroxide, ammonium hydroxide, sodium carbonate, potassium carbonate, sodium sulfate, sodium metaborate and borax. It may further contain various additives, for example, benzyl alcohol, or an alkali metal halide such as potassium chloride, or a development regulating agent such as citrazinic acid, a preservative such as hydroxylamine or sulfite.

Further, the processing solution may contain various defoaming agents, surface active agents, and organic solvents such as methanol, dimethylformamide and dimethylsulfoxide.

The pH value of the processing solution is generally 7 or higher, preferably in the range of approximately 9 to 13.

Also, the processing solution in accordance with the present invention may be added with an anti-oxidant such as hydroxylamine, ascorbic acid, tetronic acid, tetoneimide, 2-anilinoethanol, dihydroxyacetone, aromatic secondary alcohol, hydroxamic acid, pentose, hexose, or pyrogallol-1,3-dimethylether.

The processing solution in accordance with the present invention is applicable to general silver halide color photographic materials such as a color negative film, color paper, a color positive film, a color reversal film, and color reversal paper.

With the processing solution of the present invention, no amine crystal deposits in the replenisher tank and pipes even at cold districts and under cold weather, and crystal deposition caused by amine due to evaporation at the liquid boundary in the replenisher tank is eliminated even when the solution is stored for long periods at hot or dry districts such as tropics and deserts. Also, it is possible to quickly achieve dissolution and to maintain a high pH value.

In a further embodiment of the present invention, the silver halide color photographic material contains a sensitizing dye represented by the general formula [D]:

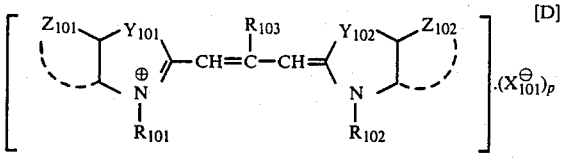

[D]

wherein $Y_{101}$ and $Y_{102}$ are independently selected from the group consisting of oxygen atom and sulfur atom: $Z_{101}$ and $Z_{102}$ independently represent a group of atoms necessary to complete a benzene ring or a naphtharene ring which is fused to an oxazole ring or a thiazole ring, in which a heterocyclic ring nucleus thus formed may have a substituent; $R_{101}$ and $R_{102}$ are independently selected from the group consisting of an alkyl group, an alkenyl group and an aryl group; $R_{103}$ is selected from the group consisting of a hydrogen atom, and an alkyl group having 1 to 3 carbon atoms; $X_{101}^{\ominus}$ is an anion; and p is 0 or 1.

According to another preferably embodiment of the present invention, the silver halide color photographic material used in the present invention contains a high boiling point organic solvent having a dielectric constant of 3.5 or higher.

In a further embodiment of the present invention, the silver halide color photographic material used in the present invention contains at least one cyan coupler represented by general formulas [C-I] to [C-III]:

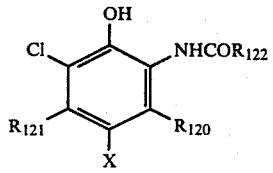

[C-I]

wherein one of $R_{120}$ and $R_{121}$ is a hydrogen atom, the other thereof is a straight chain or branched alkyl-group having 2 to 12 carbon atoms; X represents a hydrogen atom or a group releasable by a coupling reaction with an oxide of the color developing agent; and $R_{122}$ represents a ballast group.

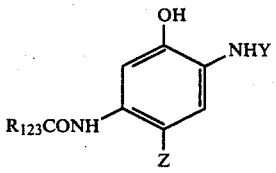

[C-II]

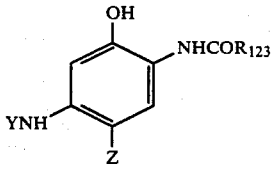

[C-III]

wherein Y is $-COR_{124}$

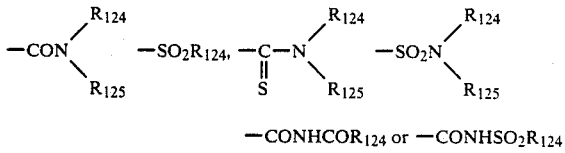

wherein $R_{124}$ is selected from the group consisting of an alkyl group, an alkenyl group, a cycloalkyl group, an aryl group, and a heterocyclic group, $R_{125}$ is selected from the group consisting of a hydrogen atom, an alkyl group, an alkenyl group, a cycloalkyl group, an aryl group and a heterocyclic group, $R_{124}$ and $R_{125}$ may combine with each other to form a 5- or 6-member heterocyclic ring; $R_{123}$ represents a ballast group; and Z represents a hydrogen atom or a group releasable by a coupling reaction with an oxide of the color developing agent.

In a still further embodiment of the present invention, the cyan coupler represented by the general formulas [C-I] to [C-III] is used in a proportion of 50 mol% or more with respect to the total cyan coupler contents.

In another embodiment of the present invention, the high boiling point organic solvent having a dielectric constant of 3.5 or higher is represented by the general formula [S-I] or [S-II].

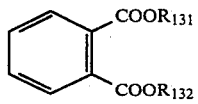

[S-I]

wherein $R_{131}$ and $R_{132}$ are independently selected from the group consisting of an alkyl group, an alkenyl group, and an aryl group.

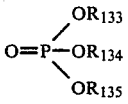

[S-II]

wherein $R_{133}$, $R_{134}$ and $R_{135}$ are independently selected from the group consisting of an alkyl group, an alkenyl group, and an aryl group.

Specifically, the inventors conducted various experiments for accomplishing the objects of the present invention, and found that generation of stains at the unexposed section can be prevented by use of a specific sensitizing dye, the effect of preventing the generation of stains at the unexposed section can further be improved by adding a certain kind of surface active agent directly to the processing solution or to the silver halide color photographic material so that the surface active agent may later be dissolved and accumulated in the processing solution. The inventors also found that processing unstability caused by differences in stirring capacity between the automatic developing machines is eliminated when a certain kind of chelating agent is added to the processing solution. The present invention is based on these findings.

The silver halide color photographic material used preferably in the present invention will now be described below.

In the general formula [D], $Z_{101}$ and $Z_{102}$ independently represent a group of atoms necessary to complete a benzene ring or a naphtharene ring which is fused to an oxazole ring or a thiazole ring. The heterocyclic ring nucleus thus formed may have a substituent. The preferable substituents are a halogen atom, an aryl group, an alkenyl group, an alkyl group and an alkoxy group. More preferable substituents are a halogen atom, a phenyl group, a methoxy group, among which a phenyl group is most preferable.

Preferably, $Z_{101}$ and $Z_{102}$ represent benzene rings or naphtharene rings fused to oxazole rings. Of these benzene rings, at least one benzene ring is substituted at 5-position by a phenyl group, and/or the other benzene rings are substituted at 5-position by a halogen atom. $R_{101}$ and $R_{102}$ are independently selected from the group consisting of an alkyl group, an alkenyl group, and an aryl group, and preferably represent an alkyl group. Preferably, $R_{101}$ and $R_{102}$ respectively represent an alkyl group substituted by a carboxyl group or a sulfo group. More preferably, $R_{101}$ and $R_{102}$ respectively represent a sulfo alkyl group having 1 to 4 carbon atoms, most preferably a sulfo ethyl group.

$R_{103}$ represents a hydrogen atom or an alkyl group having 1 to 3 carbon atoms, preferably a hydrogen atom or an ethyl group. $X_{101}{}^{63}$ represents an anion, n is 0 or 1, $Y_{101}$ and $Y_{102}$ respectively represent an oxygen atom or a sulfur atom.

The sensitizing dye represented by the general formula [D] and used in the present invention may also be used as a super sensitization combination with other sensitizing dyes. In this case, the respective sensitizing dyes may be dissolved in the same solvent or in different solvents, and these solutions may be mixed prior to addition to an emulsion or may be added independently to the emulsion. When they are added independently to the emulsion, the addition sequence and time interval may be selected arbitrarily.

Nonlimitative examples of the sensitizing dyes represented by the general formula [D] are shown below.

[D-1]

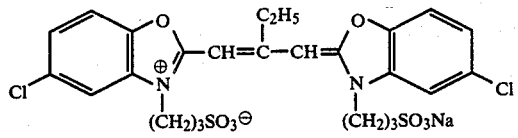

[D-2]

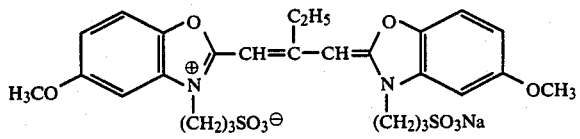

[D-3]

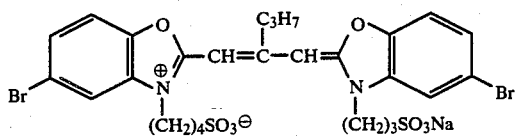

[D-4]

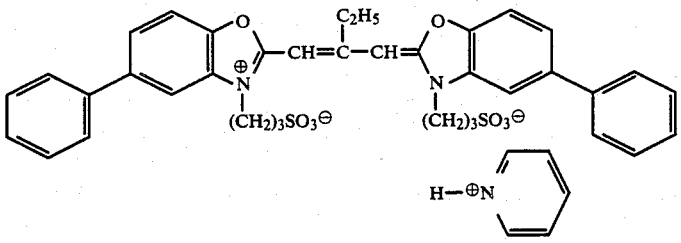

[D-5]

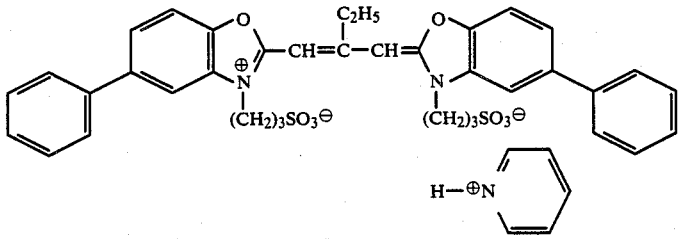

-continued
[D-6]
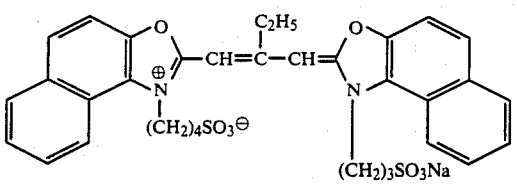
[D-7]
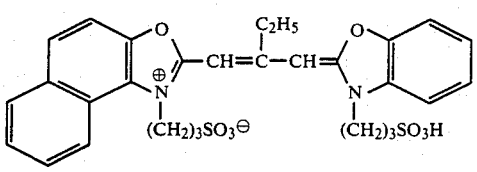
[D-8]
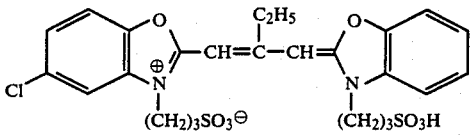
[D-9]
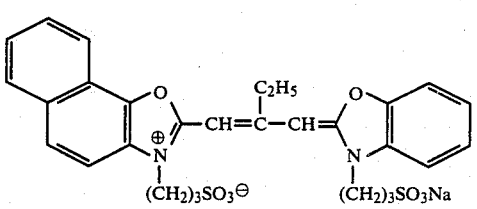
[D-10]
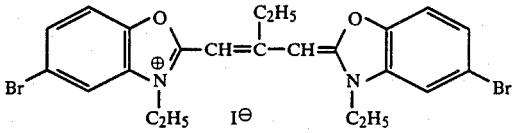
[D-11]
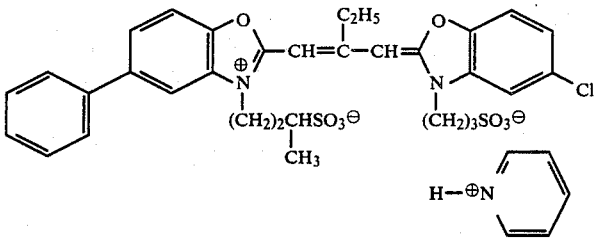
[D-12]
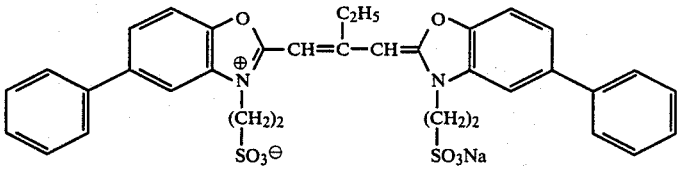
[D-13]
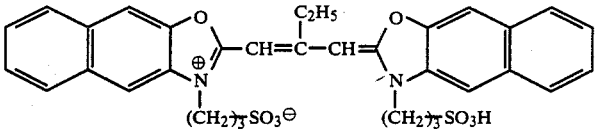
[D-14]
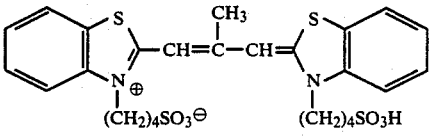
[D-15]
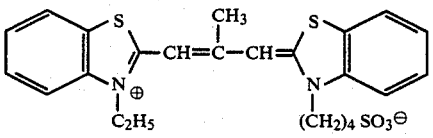
[D-16]
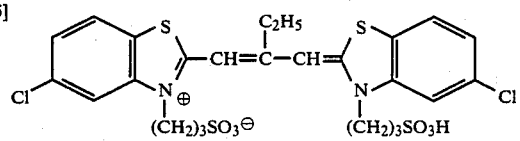
[D-17]
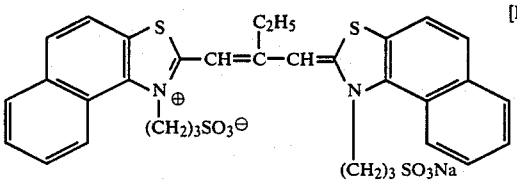
[D-18]
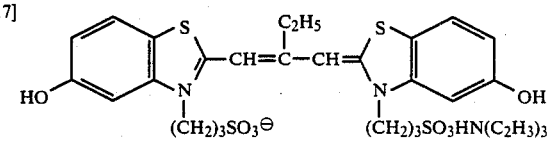

The addition of the sensitizing dye represented by the general formula [D] to the emulsion may be conducted at any stage during the emulsion preparing process, and should preferably be conducted during or after chemical ripening. The amount added should preferably be $2\times10^{-6}$ mols to $1\times10^{-3}$ mols per mol of silver halide, more preferably $5\times10^{-6}$ mols to $5\times10^{-4}$ mols per mol of silver halide.

The organic solvent used in the present invention should have a dielectric constant of 3.5 or higher and may, for example, be an ester such as a phthalic ester or a phosphoric ester, an organic acid amide, a ketone, or a hydrocarbon. Preferably, the organic solvent should be a high boiling point organic solvent having a dielectric constant of 4.0 to 8.5. More preferably, the organic solvent should be a phthalic ester or a phosphoric ester in the high boiling point organic solvent. The organic solvent used in the present invention may be a mixture of two or more solvents. In this case, the dielectric constant of the mixture should be 3.5 or higher. By "dielectric constant" is meant the dielectric constant at 30° C.

In the present invention, a phthalic ester represented by the general formula [S-I] is used advantageously.

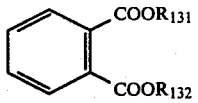

[S-I]

wherein $R_{131}$ and $R_{132}$ are independently selected from the group consisting of an alkyl group, an alkenyl group, and an aryl group. However, the sum of the carbon atoms of the groups represented by $R_{131}$ and $R_{132}$ is 2 to 36, preferably 6 to 24.

In the present invention, the alkyl group represented by $R_{131}$ and $R_{132}$ in the general formula [S-I] is a straight chain or branched alkyl group, for example, a butyl group, a pentyl group, a hexyl group, a heptyl group, an octil group, a nonyl group, a decyl group, an undecyl group, a dodecyl group, a tridecyl group, a tetradecyl group, a pentadecyl group, a hexadecyl group, a heptadecyl group, an octadecyl group, or an aryl group. The aryl group represented by $R_{131}$ and $R_{132}$ is a phenyl group, a naphthyl group or the like, and the alkenyl group is a hexenyl group, a heptenyl group, an octadecenyl group, or the like. These alkyl group, alkenyl group and aryl group may have a single substituent or many substituents. The substituents of the alkyl group and the alkenyl group may, for example, be a halogen atom, an alkoxy group, an aryl group, an aryloxy group, an alkenyl group, or an alkoxycarbonyl group. The substituent of the aryl group may, for example, be a halogen atom, an alkyl group, an alkoxy group, an aryl group, an aryloxy group, an alkenyl group, or an alkoxycarbonyl group. Two or more of these substituents may be introduced to the alkyl group, the alkenyl group or the aryl group.

The phosphoric ester used advantageously in the present invention is the one represented by the general formula [S-II].

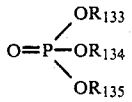

wherein $R_{133}$, $R_{134}$ and $R_{135}$ are independently selected from the group consisting of an alkyl group, an alkenyl group, and an aryl group. However, the sum of carbon atoms of the groups represented by $R_{133}$, $R_{134}$ and $R_{135}$ is 3 to 54.

In the present invention, the alkyl group represented by $R_{133}$, $R_{134}$ and $R_{135}$ in the general formula [S-II] is a straight chain or branched alkyl group and may, for example, be a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, or a nonadecyl group.

These alkyl group, alkenyl group and aryl group may have a single substituent or many substituents. Preferably, $R_{133}$, $R_{134}$ and $R_{135}$ are an alkyl group such as a n-bytul group, a 2-ethylhexyl group, a n-octil group, a 3,5,5-trimethylhexyl group, a n-nonyl group, a n-decyl group, a sec-decyl group, a sec-dodecyl group, or a t-octil group.

The alkenyl group may be an ethylene group, an allyl group, or a butene group, and the aryl group may be a phenyl group, a tolyl group, or a xylyl group.

Nonlimitative examples of the high boiling point organic solvent having a dielectric constant of 3.5 or higher are shown below.

Examples of compound]

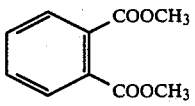

A-1

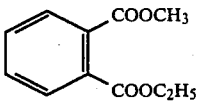

A-2

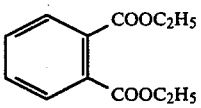

A-3

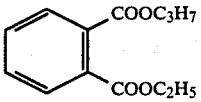

A-4

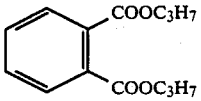

A-5

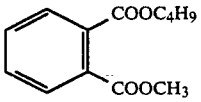

A-6

-continued
A-7
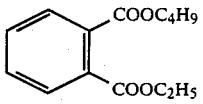
A-8
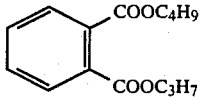
A-9
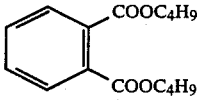
A-10
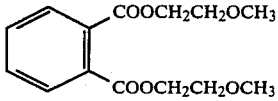
A-11
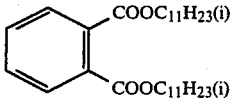
A-12
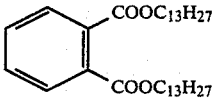
A-13
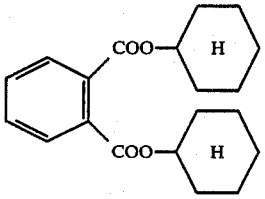
A-14
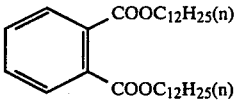
A-15
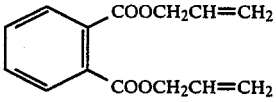
A-16
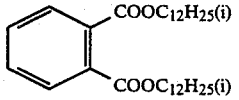
A-17
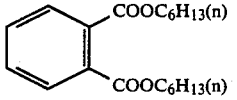
A-18
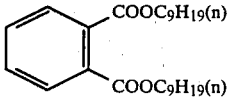
-continued
A-19
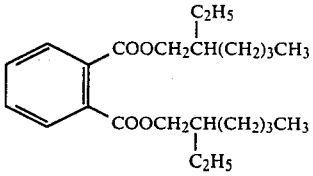
A-20
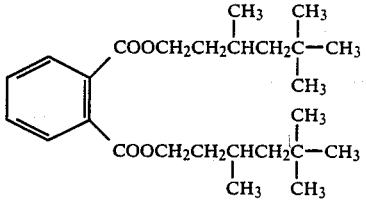
A-21
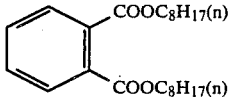
A-22
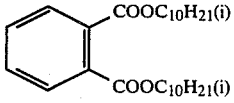
A-23
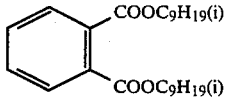
A-24
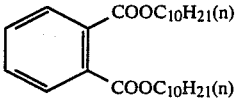
A-25
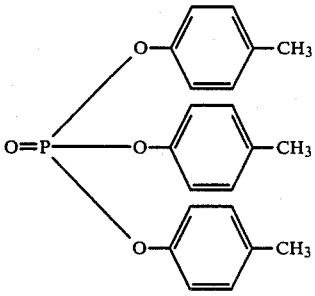
A-26
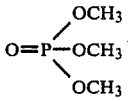
A-27
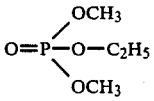
A-28
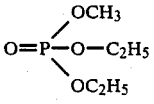
A-29
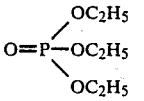

-continued

A-30 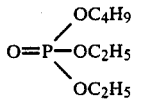

A-31 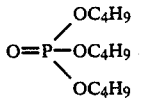

A-32 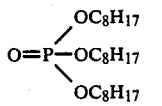

A-33 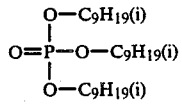

A-34 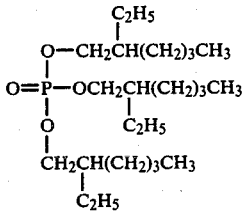

A-35 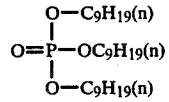

A-36 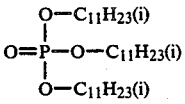

A-37 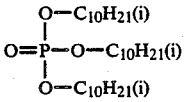

A-38 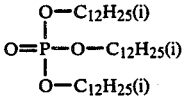

A-39 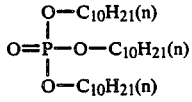

As the high boiling point organic solvent having a dielectric constant of 3.5 or higher, it is also possible to use, for example, diethyl malonate, diethyl meleate, γ-butyrolactone, methyl benzoate, benzylalcohol, or 1-octanol.

The high boiling point organic solvent in the present invention may be used together with a known low boiling point organic solvent such as ethyl acetate.

The cyan coupler in the present invention is represented by the general formulas [C-I] to [C-III]. The general formula [C-I] will described in detail below.

In the present invention, the straight chain or branched alkyl group having 2 to 12 carbon atoms and represented by $R_{120}$ and $R_{121}$ in the general formula [C-I] may, for example, be an ethyl group, a propyl group, or a butyl group.

In the general formula [C-I], the ballast group represented by $R_{122}$ is an organic group having a size and a shape capable of imparting, to the coupler, a volume sufficient for rendering the coupler substantially nondispersable from the layer, to which the coupler is applied, to the other layers. The typical ballast group is an alkyl group or an aryl group having 8 to 32 carbon atoms in total, preferably 13 to 28 carbon atoms in total. The alkyl group and the aryl group may have a substituent. The substituent of the aryl group may, for example, be an alkyl group, an aryl group, an alkoxy group, an allyloxy group, a carboxyl group, an acyl group, an ester group, a hydroxyl group, a cyano group, a nitro group, a carbamoyl group, a carboxylic acid amide group, an alkyl thio group, an aryl thio group, a sulfonyl group, a sulfonamide group, a sulfamoyl group or a halogen. The substituent of the alkyl group may be the substituents mentioned for the aryl group, excluding the aryl group.

As the ballast group, the group represented by the following general formula is preferable.

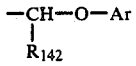

wherein $R_{142}$ represents an alkyl group having 1 to 12 carbon atoms, and Ar represents an aryl group such as a phenyl group, which may be substituted. The substituent of the aryl group may be an alkyl group, a hydroxyl group, a halogen atom, or an alkylsulfonamide group, among which the most preferable group is a branched alkyl group such as a t-butyl group.

The group represented by X in the general formula [C-I], which is releasable by coupling with an oxide of the color developing agent, decides the equivalents of the coupler as is well known in the art, and governs the coupling reactivity. Typical examples are a halogen such as chlorine or fluorine, an arloxy group, a substituted or unsubstituted alkoxy group, an acyloxy group, a sulfonamide group, an arylthio group, a heteroylthio group, a heteroyloxy group, a sulfonyloxy group, and a carbamoyloxy group. Further typical examples are described in Japanese Unexamined Patent Publication Nos. 50-10135, 50-120334, 50-130414, 54-48237, 51-146828, 54-14736, 47-37425, 50-123341, and 58-95345, Japanese Patent Publication No. 48-36894, and U.S. Pat. Nos. 3,476,563, 3,737,316 and 3,227,551.

Nonlimitative examples of the cyan coupler represented by the general formula [C-I] are shown below. As the examples, those represented by the general formula [C-I] wherein $R_{121}$, X, $R_{122}$ and $R_{120}$ have the meanings shown below are mentioned.

| Coupler No. | $R_{121}$ | X | $R_{122}$ | $R_{120}$ |
|---|---|---|---|---|
| C-1 | $-C_2H_5$ | $-H$ | 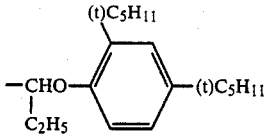 | $-H$ |
| C-2 | $-O_2H_5$ | $-Cl$ | 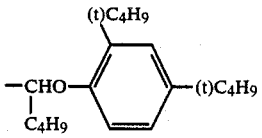 | $-H$ |
| C-3 | $-C_2H_5$ | $-H$ | 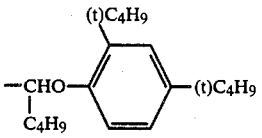 | $-H$ |
| C-4 | $-C_2H_5$ | $-Cl$ | 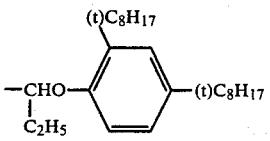 | $-H$ |
| C-5 | $-C_2H_5$ | $-Cl$ | 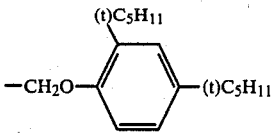 | $-H$ |
| C-6 | $-C_2H_5$ | 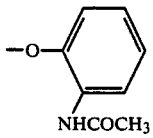 | 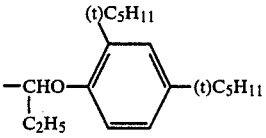 | $-H$ |
| C-7 | 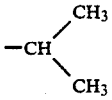 | $-Cl$ | 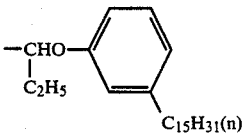 | $-H$ |
| C-8 | $-C_2H_5$ | $-Cl$ | 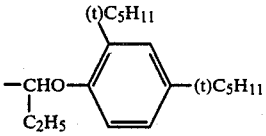 | $-H$ |
| C-9 | $-C_2H_5$ | $-Cl$ | 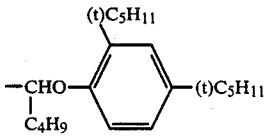 | $-H$ |
| C-10 | $-C_4H_9$ | $-F$ | 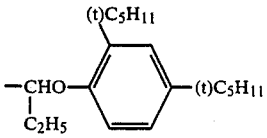 | $-H$ |

-continued
| Coupler No. | $R_{121}$ | X | $R_{122}$ | $R_{120}$ |
|---|---|---|---|---|
| C-11 | $-C_2H_5$ | $-F$ | 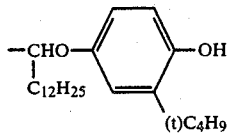 | $-H$ |
| C-12 | $-C_2H_5$ | $-Cl$ | 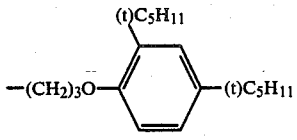 | $-H$ |
| C-13 | $-C_2H_5$ | $-F$ | 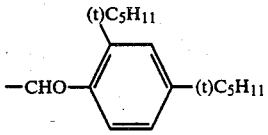 | $-H$ |
| C-14 | $-C_4H_9$ | $-Cl$ | 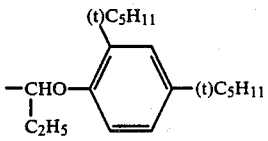 | $-H$ |
| C-15 | $-C_2H_5$ | $-Cl$ | 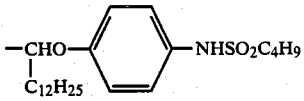 | $-H$ |
| C-16 | $-C_2H_5$ | $-Cl$ | 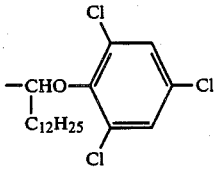 | $-H$ |
| C-17 | 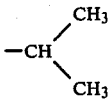 | $-Cl$ | $-C_{18}H_{37}$ | $-H$ |
| C-18 | $-C_2H_5$ | $-F$ | 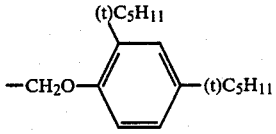 | $-H$ |
| C-19 | $-C_2H_5$ | 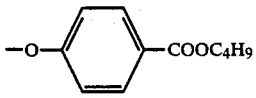 | 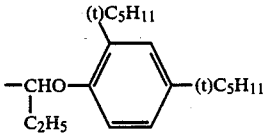 | $-H$ |
| C-20 | $-C_2H_5$ | $-Cl$ | 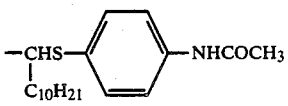 | $-H$ |
| C-21 | $-C_3H_7$ | $-Cl$ | 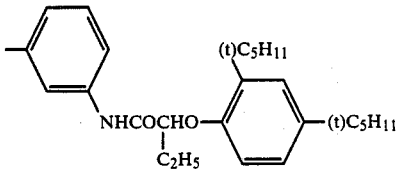 | $-H$ |

-continued

| Coupler No. | $R_{121}$ | X | $R_{122}$ | $R_{120}$ |
|---|---|---|---|---|
| C-22 | $-C_3H_7$ | $-Cl$ | 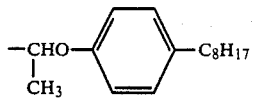 | $-H$ |
| C-23 | $-C_2H_4NHCOCH_3$ | $-Cl$ | 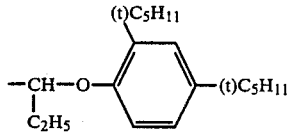 | $-H$ |
| C-24 | $-C_3H_6OCH_3$ | $-Cl$ | 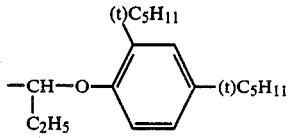 | $-H$ |
| C-25 | $-H$ | $-Cl$ | 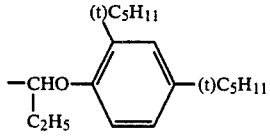 | $-C_2H_5$ |
| C-26 | $-H$ | $-Cl$ | 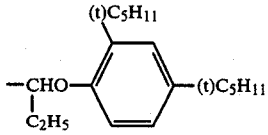 | $-C_3H_7$ |
| C-27 | $-H$ | $-Cl$ | 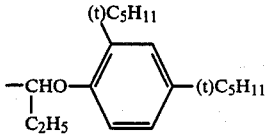 | $-C_5H_{11}$ |
| C-28 | $-C_2H_5$ | $-Cl$ | 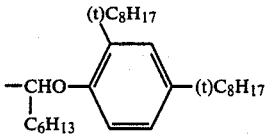 | $-H$ |

The synthetic methods for the compounds shown by way of example are described below. The other examples of the compounds can be synthesized by similar methods.

Synthesis of compound C-5

[(1)-a] 2-Nitro-4,6-dichloro-5-ethyl phenol

First, 33 g of 2-nitro-5-ethylphenol, 0.6 g of iodine, and 1.5 g of ferric chloride were dissolved in 150 ml of glacial acetic acid. To the solution, 75 ml of sulfuryl chloride were added dropwise within three hours at 40° C. After the dropwise addition of sulfuryl chloride was finished, precipitates generated during the dropwise addition were reacted and dissolved under reflux with heat. It took approximately two hours for the reflux with heat. The reaction mixture was added to water, and crystals generated were purified by recrystallization with methanol. Identification of (1)-a was conducted by nuclear magnetic resonance spectrum and elemental analysis.

[(1)-b] 2-Nitro-4,6-dichloro-5-ethylphenol

In 300 ml alcohol, 21.2 g of the compound [(1)-a] were dissolved. A catalytic amount of Raney nickel was added to the solution, and hydrogen was introduced at normal pressure until hydrogen absorption disappeared. After the reaction, Raney nickel was removed, and alcohol was removed by vacuum distillation. The residue comprising [(1)-b] was then subjected to acylation without purification.

[(1)-c] 2[(2,4-di-tert-acylphenoxy)acetoamide]-4,6-dichloro-5-ethylphenol

Then, 18.5 g of the crude amide obtained in the synthesis of [(1)-b] were dissolved in a mixture of 500 ml of glacial acetic acid with 16.7 g of sodium acetate. An acetic acid solution containing 50 ml of acetic acid in 28.0 g of 2,4-di-tert-acylphenoxyacetic acid chloride was then added dropwise to the aforesaid mixture at room temperature over 30 minutes. The mixture thus formed was stirred for 30 minutes, and the reaction mixture was introduced into an ice-water bath. Precipitates generated were taken up by filtration, dried and recrystallized twice with acetonitrile to obtain the target compound. Identification of the target compound was conducted by elemental analysis and nuclear magnetic resonance spectrum.

| | $C_{21}H_{25}NO_3Cl$ | | | |
|---|---|---|---|---|
| | C | H | N | |
| Calculated value (%) | 65.00 | 7.34 | 2.92 | 14.76 |
| Measured value (%) | 64.91 | 7.36 | 2.99 | 14.50 |

The cyan coupler represented by the general formula [C-II] or [C-III] and used in the present invention will be described below. In the general formulas [C-I] and [C-II], Y is the group reprsented by

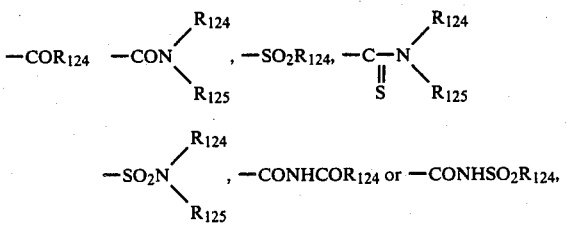

wherein $R_{124}$ is selected from the group consisting of an alkyl group, preferably an alkyl group having 1 to 20 carbon atoms such as a methyl group, an ethyl group, a t-butyl group or a dodecyl group, an alkenyl group, preferably an alkenyl group having 2 to 20 carbon atoms such as an allyl group or heptadecenyl group, a cycloalkyl group, preferably a 5- or 7-member ring cycloalkyl such as a cyclodexyl group, an aryl group such as a phenyl group, a tolyl group or a naphthyl group, and a heterocyclic group, preferably a 5- or 6-member heterocyclic group containing 1 to 4 nitrogen, oxygen or sulfur atoms, for example, a furyl group, a thienyl group or a benzothiazolyl group; and $R_{125}$ represents a hydrogen atom or a group represented by $R_{124}$. $R_{124}$ and $R_{125}$ may combine with each other to form a 5- or 6-member heterocyclic ring. $R_{122}$ and $R_{123}$ may have any substituent, for example, an alkyl group having 1 to 10 carbon atoms such as a methyl group, an i-propyl group, an i-butyl group, a t-butyl group or a t-octyl group, an aryl group such as a phenyl group or a naphthyl group, a halogen atom such as fluorine, chlorine or bromine, a cyano group, a nitro group, a sulfonamide group such as methane sulfonamide, butane sulfonamide, or p-toluene sulfonamide, a sulfamoyl group such as methyl sulfamoyl or phenyl sulfamoyl, a sulfonyl group such as methane sulfonyl or p-toluene sulfonyl, a fluorosulfonyl group, a carbamoyl group such as dimethyl carbamoyl or phenyl carbamoyl, an oxycarbonyl group such as ethoxy carbonyl or phenoxy carbonyl, an acyl group such as acetyl or benzoyl, a heterocyclic group such as a pyridyl group or a pyrazolyl group, an alkoxy group, an aryloxy group, and an acyloxy group.

In general formulas [C-II] and [C-III], $R_{123}$ represents a ballast group necessary for imparting anti-diffusion property to the cyan coupler represented by the general formula [C-II] or [C-III] and the cyan dye formed by the cyan coupler. Preferably, $R_{123}$ represents an alkyl group, an aryl group or a heterocyclic group each having 4 to 30 carbon atoms, for example, a straight chain or branched alkyl group such as t-butyl, n-octyl, t-octyl or n-dodecyl, an alkenyl group, a cycloalkyl group, or 5- or 6-member heterocyclic group.

In the general formulas [C-II] and [C-III], Z represents a hydrogen atom or a group releasable during the coupling reaction with an oxide of the N-hydroxyalkyl substituted p-phenylenediamine derivative developing agent. For example, Z represents a halogen atom such as chlorine, bromine or fluorine, a substituted or unsubstituted alkoxy group, an aryloxy group, a heterocyclic oxy group, an acyloxy group, a carbamoyloxy group, a sulfonyloxy group, an alkylthio group, an arylthio group, a heterocyclic thio group, or a sulfonamide group. Typical examples are described in U.S. Pat. No. 3,741,563, Japanese Unexamined Patent Publication Nos. 47-37425, 50-10135, 50-117422, 50-130441, 51-108841, 50-120343, 52-18315, 53-105226, 54-14736, 54-48237, 55-32071, 55-65957, 56-1938, 56-12643, 56-27147, 59-146050, 59-166956, 60-24547, 60-35731, and 60-37557, and Japanese Patent Publication No. 48-36894.

Of the cyan couplers represented by the general formula [C-II] or [C-III], the cyan couplers represented by the following general formula [C-IV], [C-V] or [C-VI] are preferable in the present invention.

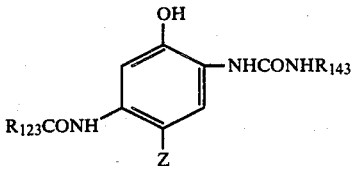

[C-IV]

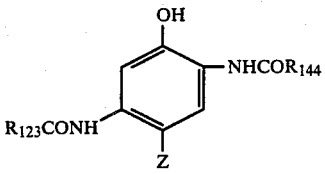

[C-V]

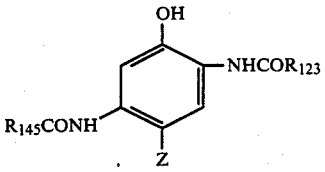

[C-VI]

In the general formula [C-IV], $R_{143}$ represents a substituted or unsubstituted aryl group, preferably a phenyl group. The aryl group has at least one substituent, the substituent may be selected from the group consisting of $SO_2R_{146}$, a halogen atom such as fluorine, chlorine or bromine, $-CF_3$, $-NO_2$, $-CN$, $-COR_{146}$, $-COOR_{146}$, $-SO_2OR_{146}$,

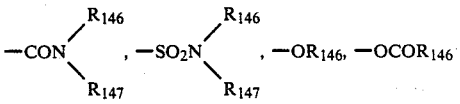

-continued

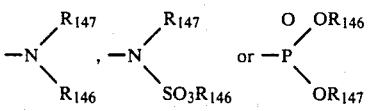

wherein $R_{146}$ is selected from the group consisting of an alkyl group, preferably an alkyl group having 1 to 20 carbon atoms such as a methyl group, an ethyl group, a tert-butyl group or a dodecyl group, an alkenyl group, preferably an alkenyl group having 2 to 20 carbon atoms such as an allyl group or a heptadecenyl group, or a cycloalkyl group, preferably a 5- to 7-member cyclic group such as cyclohexyl, aryl group such as a phenyl group, a tolyl group or a naphthyl group, and $R_{147}$ represents a hydrogen atom or a group represented by $R_{146}$.

As the cyan coupler represented by the general formula [C-IV], the compound represented by the general formula [C-IV] wherein $R_{143}$ is a substituted or unsubstituted phenyl group, and the substituent on the phenyl group is cyano, nitro, $—SO_2R_{148}$ (wherein $R_{148}$ is an alkyl group), a halogen atom, or trifluoromethyl.

In the general formulas [C-V] and [C-VI], $R_{144}$ and $R_{145}$ are independently selected from the group consisting of an alkyl group, preferably an alkyl group having 1 to 20 carbon atoms such as methyl, ethyl, tert-tubyl, or dodecyl, an alkenyl group, preferably an alkenyl group having 2 to 20 carbon atoms such as an allyl group or an oleyl, a cycloalkyl group, preferably a 5- to 7-member cyclic group such as cyclohexyl, an aryl group such as a phenyl group, a tolyl group or a naphthyl group, and a heterocyclic group, preferably a 5- or 6-member heterocyclic group containing 1 to 4 nitrogen, oxygen or sulfur atoms such as furyl group, a thienyl group or a benzothiazolyl group.

$R_{146}$ and $R_{147}$, as well as $R_{144}$ and $R_{145}$ in the general formulas [C-V] and [C-VI] may further have any substituents, for example, the substituents which may be introduced to $R_{124}$ or $R_{125}$ in the general formulas [C-II] and [C-III]. A halogen atom such as chlorine or fluorine is particularly preferable as the substituent.

In the general formulas [C-IV], [C-V] and [C-VI], Z and $R_{123}$ have the same meanings as those in the general formulas [C-II] and [C-III]. Preferred examples of the ballast group represented by $R_{123}$ are those represented by the following general formula [B].

[B]

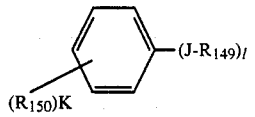

wherein J represents an oxygen atom, a sulfur atom or a sulfonyl group, K represents an integer of 0 to 4, l represents 0 or 1, and $R_{150}$ may be the same or different when K represents an integer of 2 or larger. $R_{149}$ represents a straight chain or branched alkylene group having 1 to 20 carbon atoms, which may be substituted by an aryl group or the like. $R_{150}$ represents a monovalent group, preferably a hydrogen atom, a halogen atom such as chlorine or bromine, an alkyl group preferably a straight chain or branched alkyl group having 1 to 20 carbon atoms such as methyl, t-butyl, t-pentyl, t-octil, dedecyl, pentadecyl, benzyl or phenethyl, an aryl group such as a phenyl group, a heterocyclic group such as a nitrogen-containing heterocyclic group, an alkoxy group, preferably a straight chain or branched alkoxy group having 1 to 20 carbon atoms such as methoxy, ethoxy, t-butyloxy, octyloxy, decyloxy, dodecyloxy, an aryloxy group such as a phenoxy group, a hydroxyl group, an acyloxy group, preferably an alkylcarbonyloxxy group, an arylcarbonyloxy group such as an acetoxy group or a benzoyloxy group, a carboxyl group, an alkyloxycarbonyl group, preferably a straight chain or branched alkylcarbonyl group having 1 to 20 carbon atoms, preferably a phenoxycarbonyl group, an alkylthio group, preferably an acyl group having 1 to 20 carbon atoms, preferably a straight chain or branched alkylcarbonyl group having 1 to 20 carbon atoms, an acylamino group, preferably a straight chain or branched alkylcarboamide group having 1 to 20 carbon atoms, a benzenecarbomide group, a sulfonamide group, preferably a straight chain or branched alkylsulfonemide group having 1 to 20 carbon atoms or a benzenesulfonamide group, a carbamoyl group, preferably a straight chain or branched alkylaminocarbonyl group having 1 to 20 carbon atoms or a phenylaminocarbonyl group, or a sulfamoyl group, preferably a straight chain or branched alkylaminosulfonyl group having 1 to 20 carbon atoms or a phenylaminosulfonyl group.

Nonlimitative examples of the cyan coupler represented by the general formula [C-II] or [C-III] are shown below.

[Examples of compound]

(C-29)

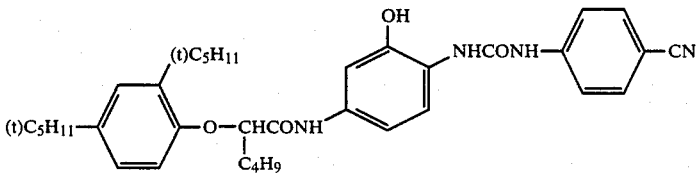

-continued
(C-30)
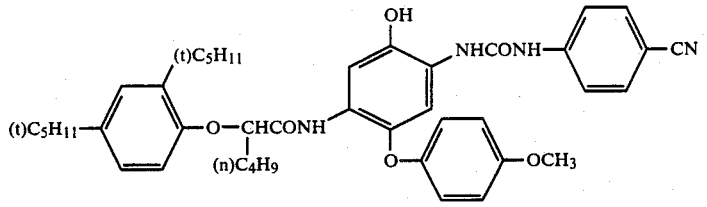
(C-31)
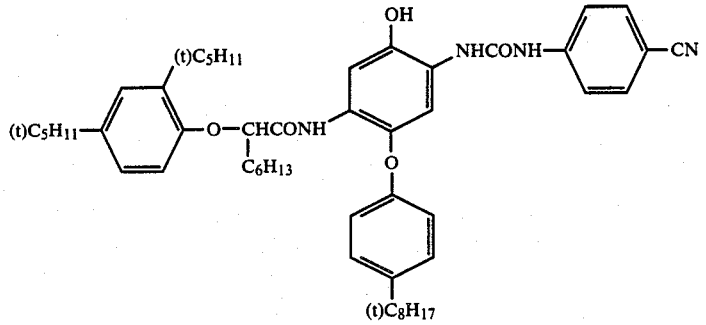
(C-32)
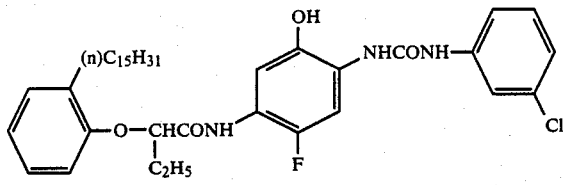
(C-33)
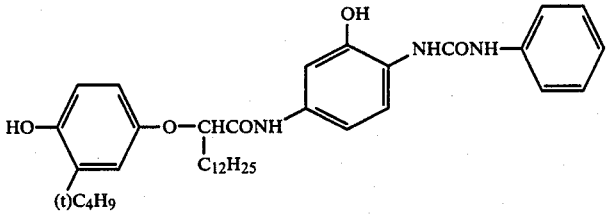
(C-34)
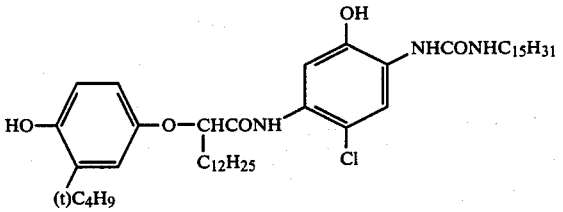
(C-35)
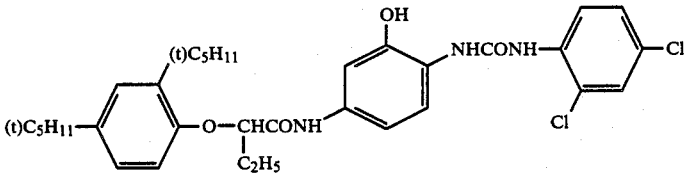
(C-36)
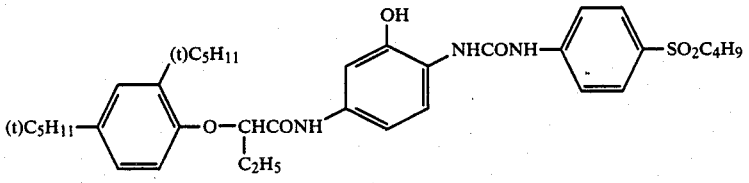

-continued
(C-37)
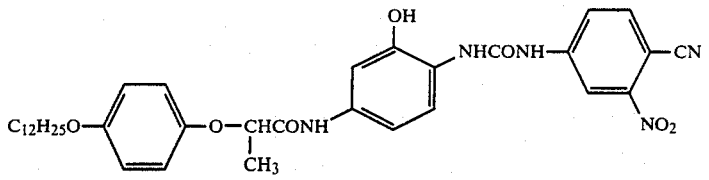
(C-38)
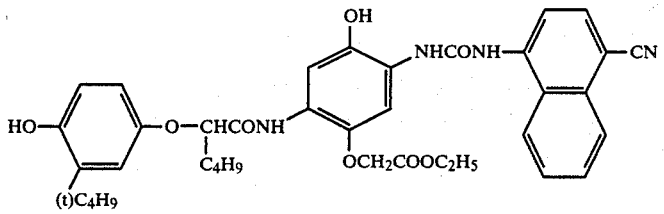
(C-39)
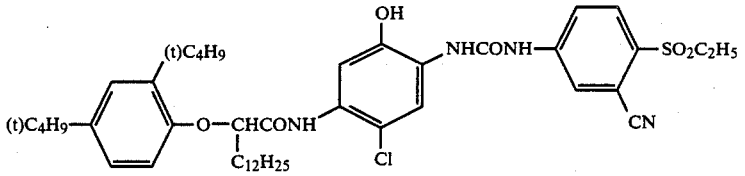
(C-40)
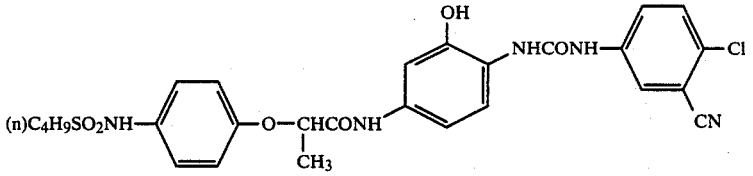
(C-41)
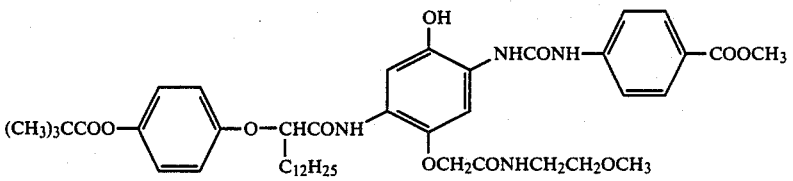
(C-42)
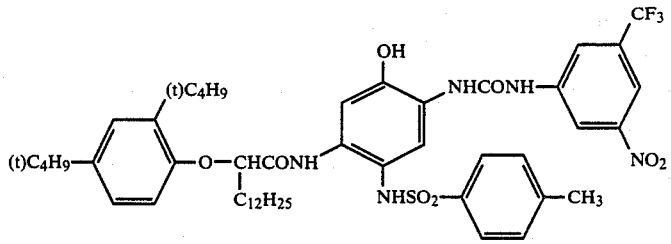
(C-43)
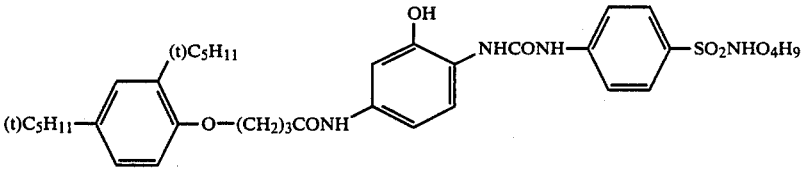
(C-44)
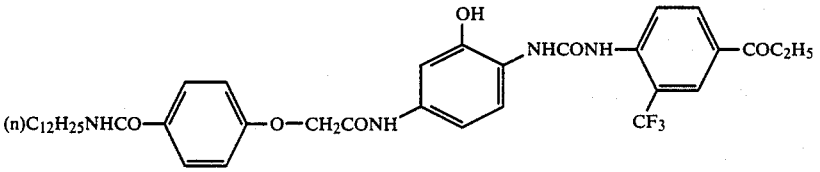

-continued
(C-45)
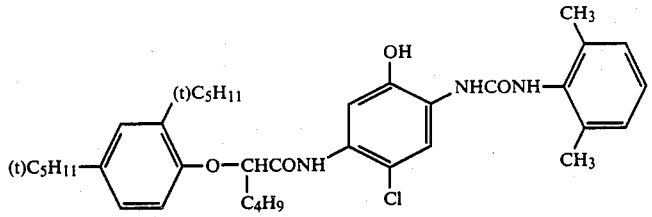
(C-46)
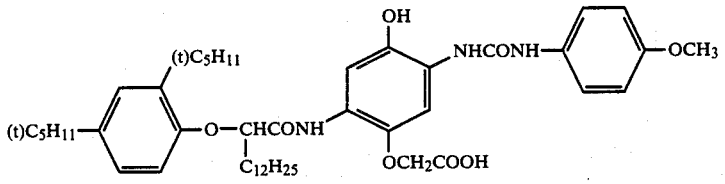
(C-47)
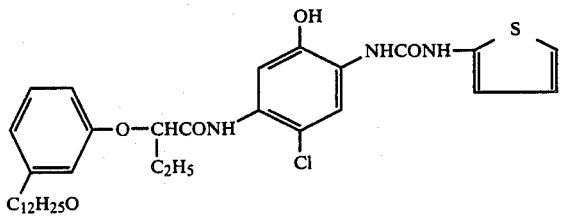
(C-48)
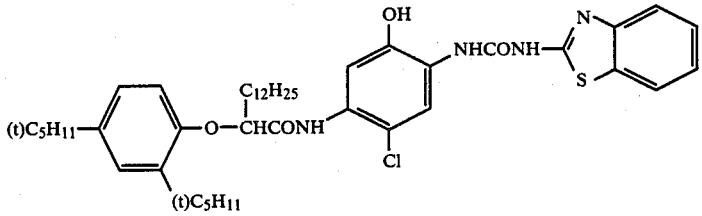
(C-49)
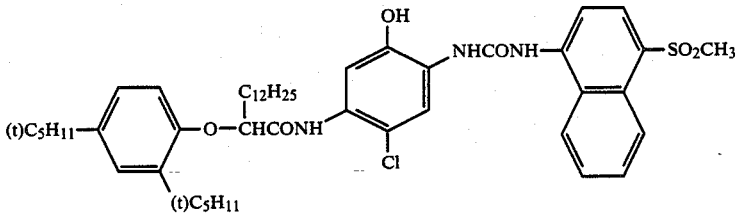
(C-50)
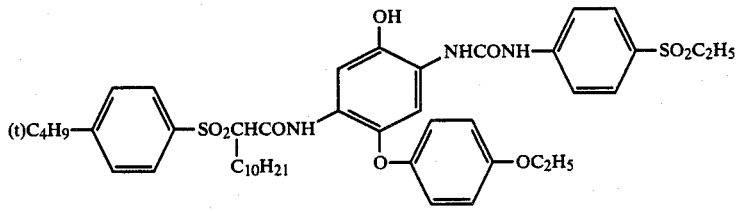
(C-51)
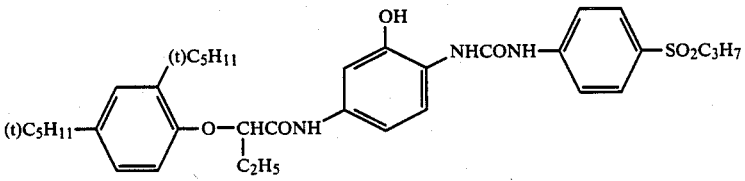

-continued
(C-52)
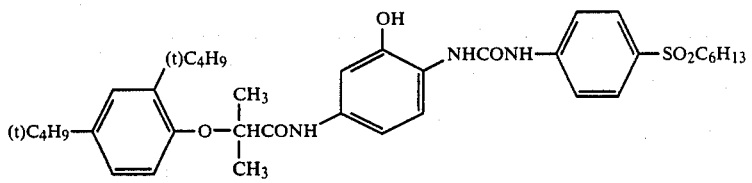
(C-53)
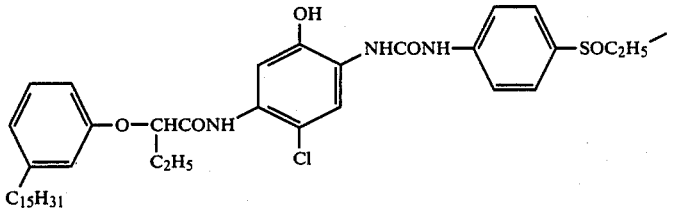
(C-54)
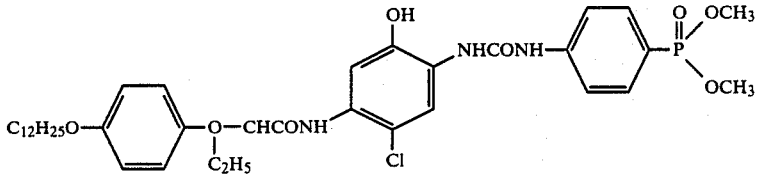
(C-55)
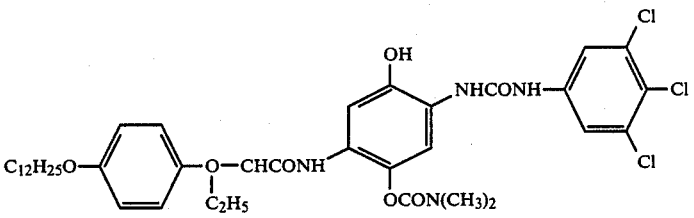
(C-56)
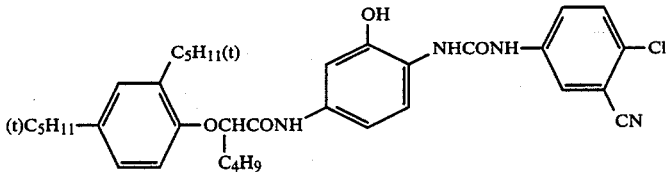
(C-57)
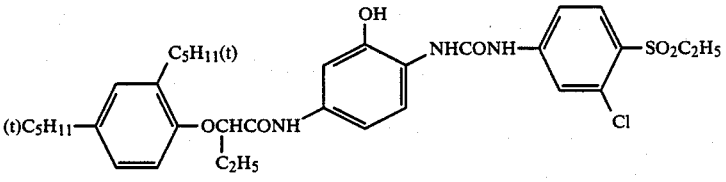
(C-58)
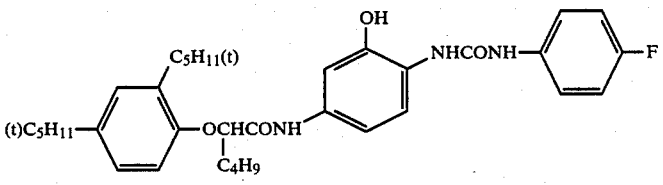
(C-59)
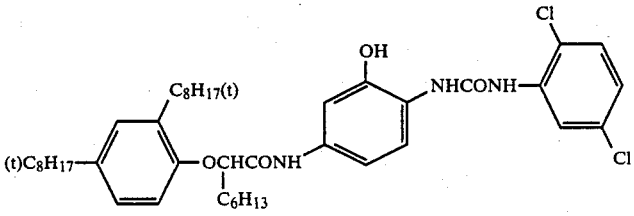

-continued
(C-60)
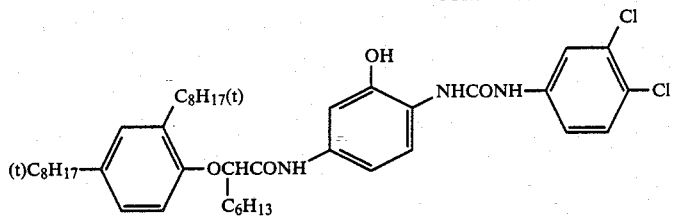
(C-61)
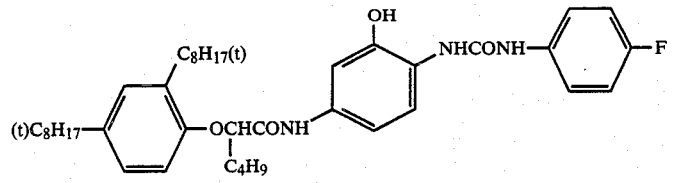
(C-62)
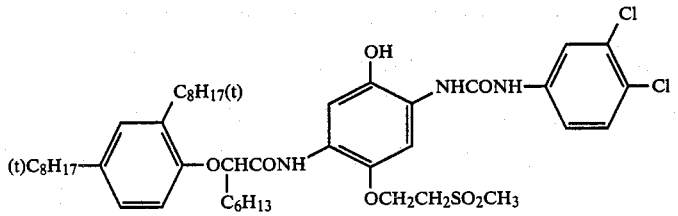
(C-63)
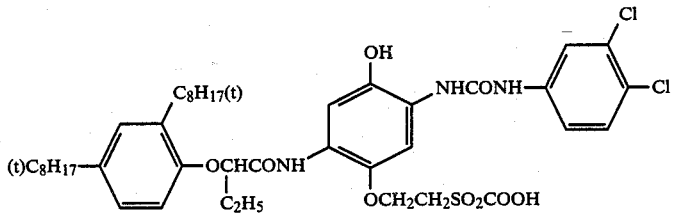
(C-64)
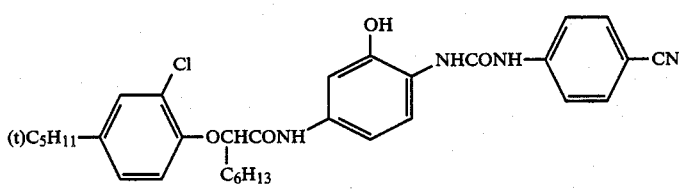
(C-65)
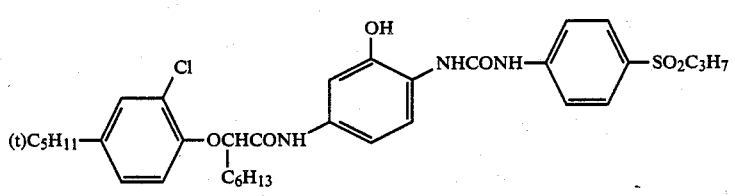
(C-66)
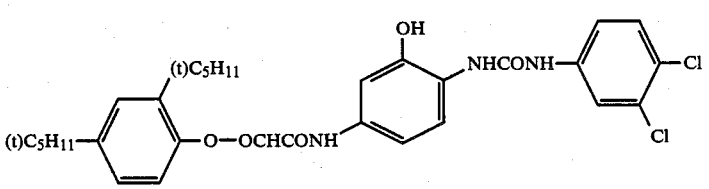
(C-67)
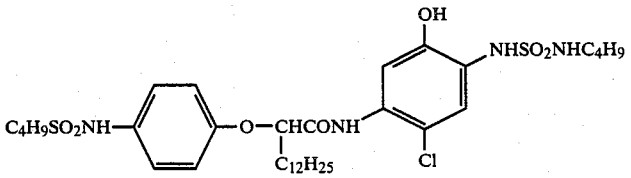

-continued
(C-68)
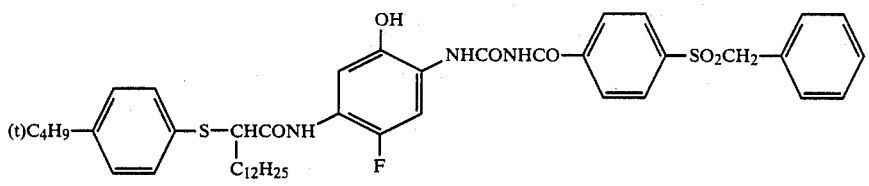
(C-69)
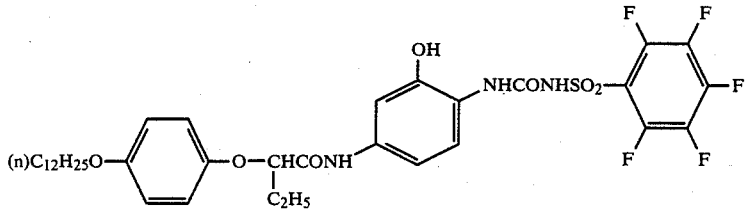
(C-70)
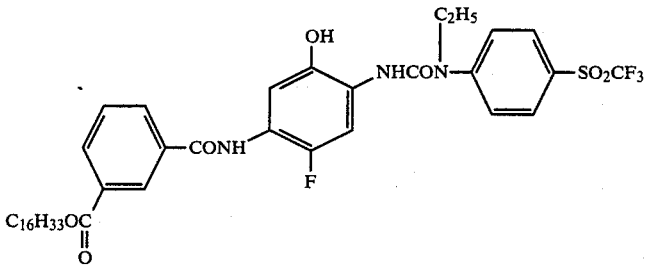
(C-71)
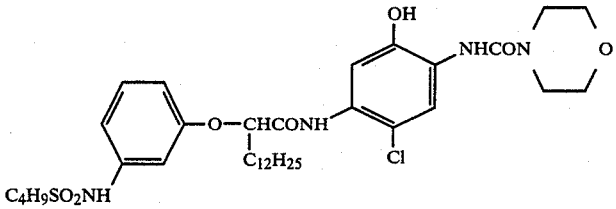
(C-72)
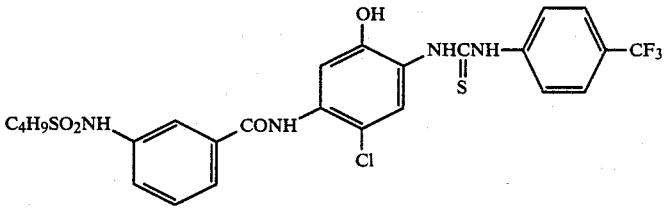
(C-73)
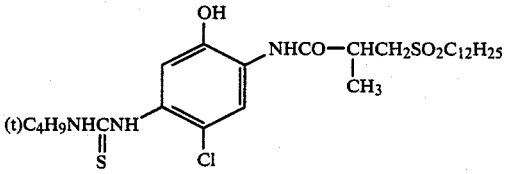
(C-74)
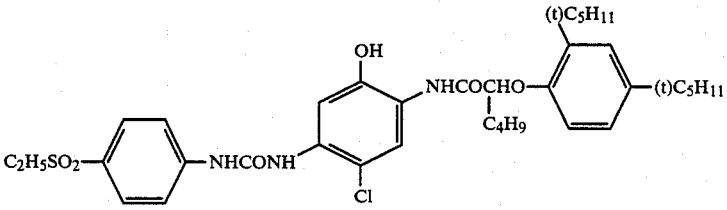

-continued
(C-75)
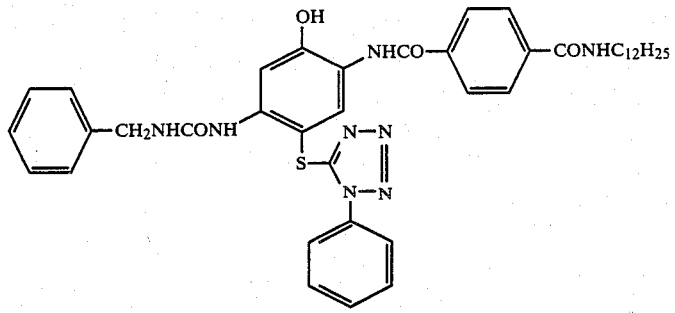
(C-76)
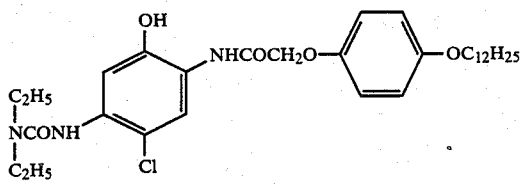
(C-77)
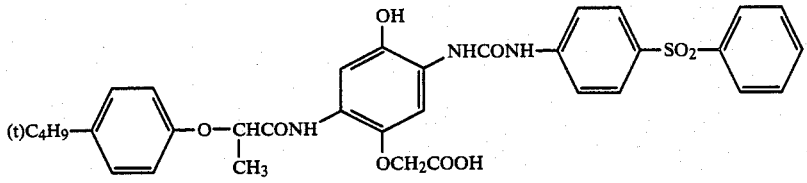
(C-78)
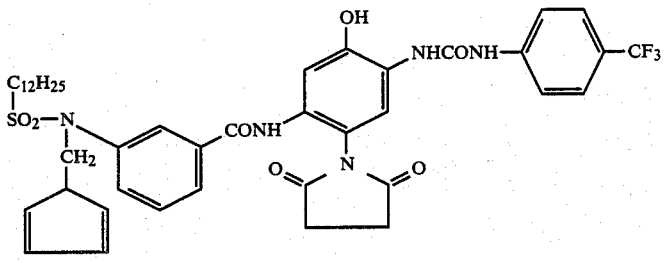
(C-79)
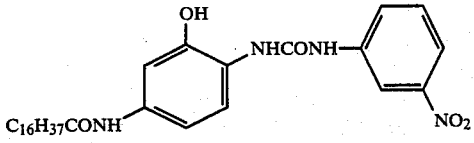
(C-80)
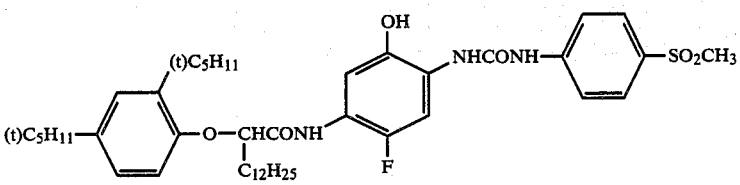
(C-81)
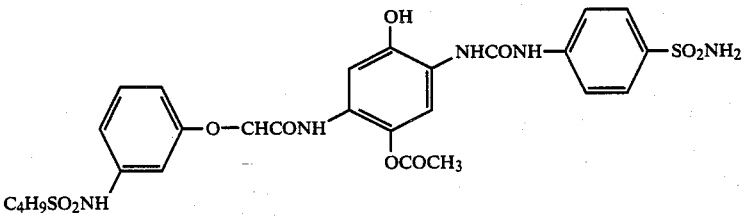

-continued
(C-82)
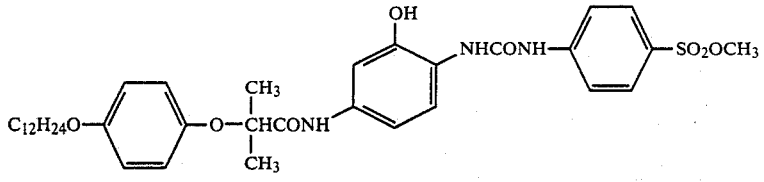
(C-83)
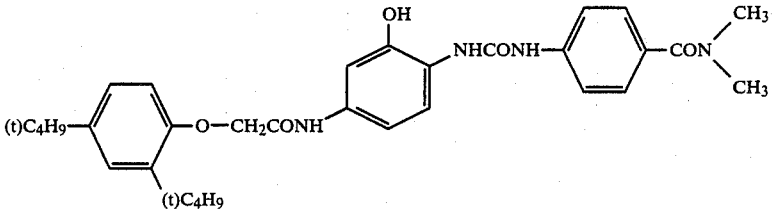
(C-84)
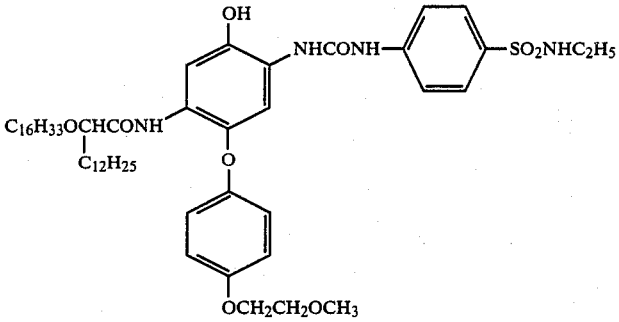
(C-85)
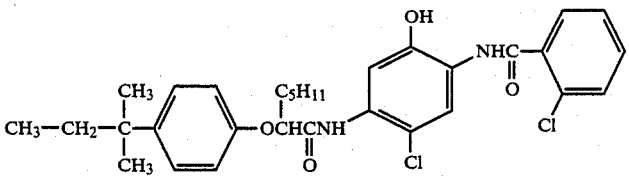
(C-86)
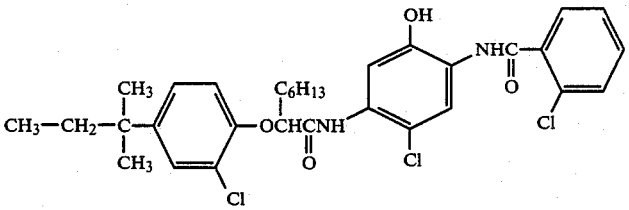
(C-87)
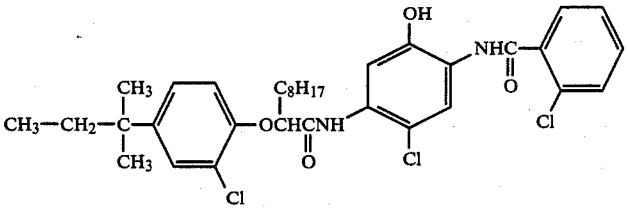
(C-88)
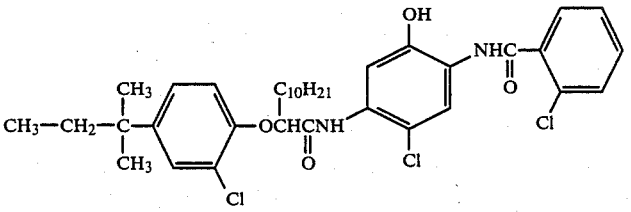

-continued
(C-89)
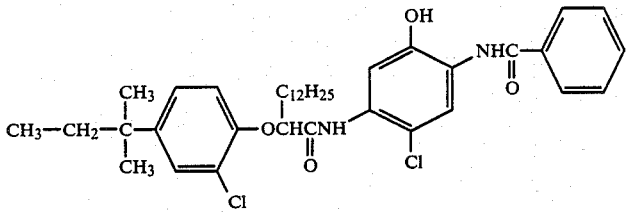
(C-90)
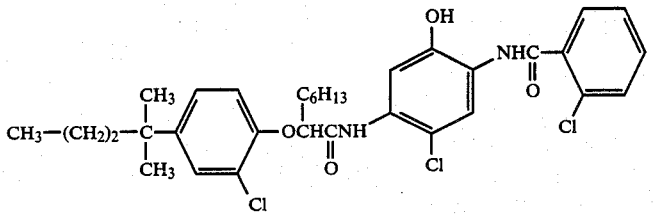
(C-91)
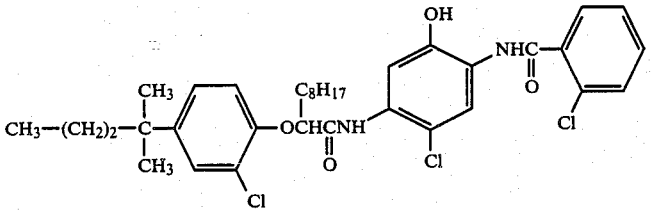
(C-92)
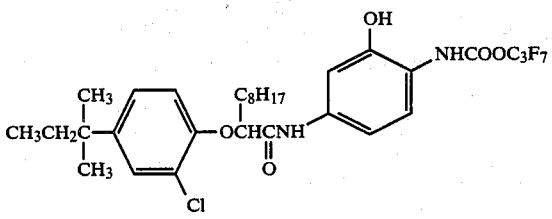
(C-93)
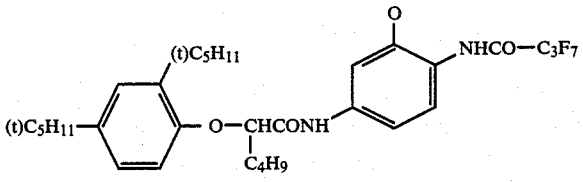
(C-94)
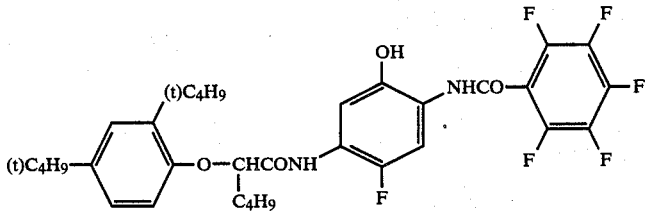
(C-95)
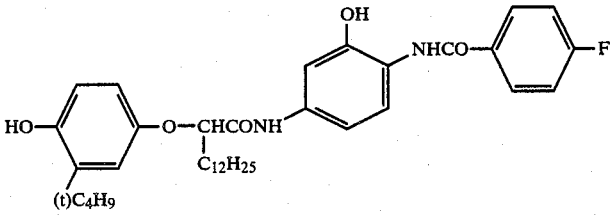

-continued
(C-96)
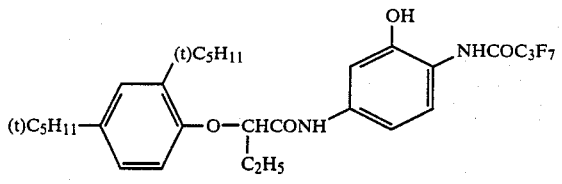
(C-97)
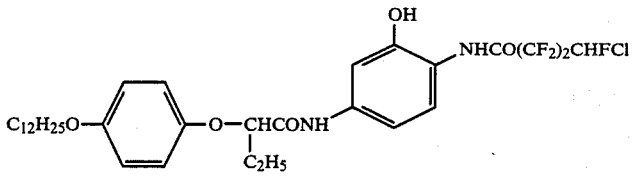
(C-98)
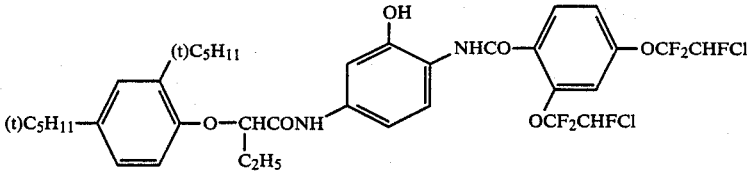
(C-99)
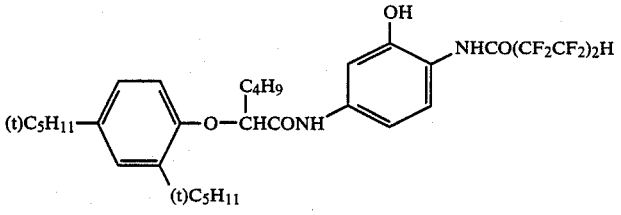
(C-100)
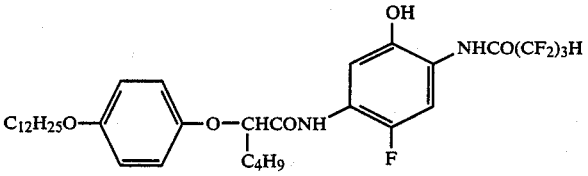
(C-101)
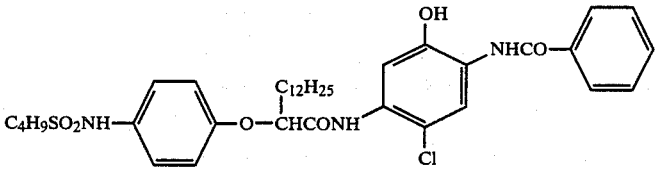
(C-102)
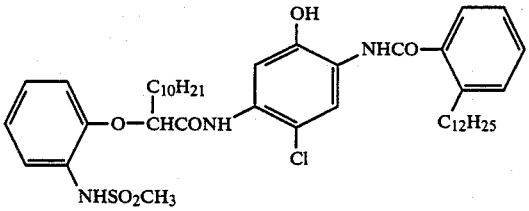
(C-103)
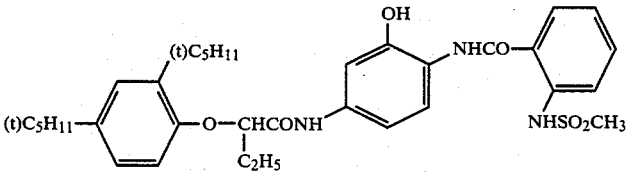

-continued
(C-104)
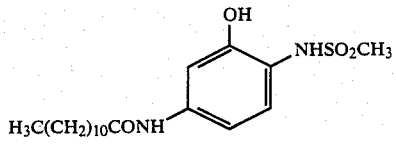
(C-105)
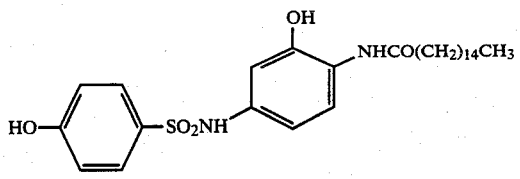
(C-106)
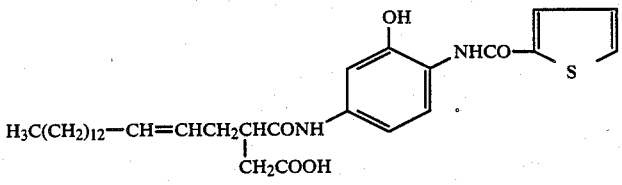
(C-107)
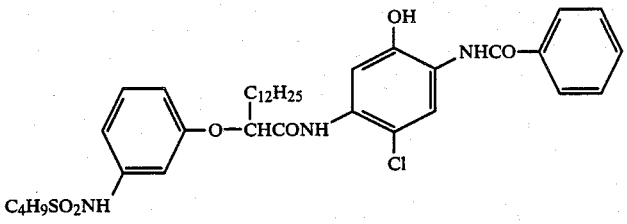
(C-108)
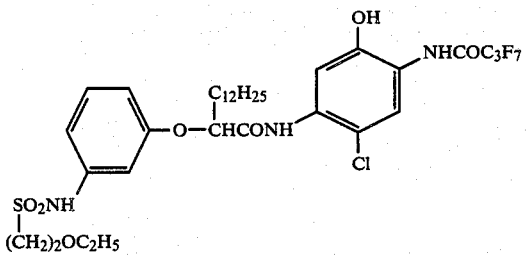
(C-109)
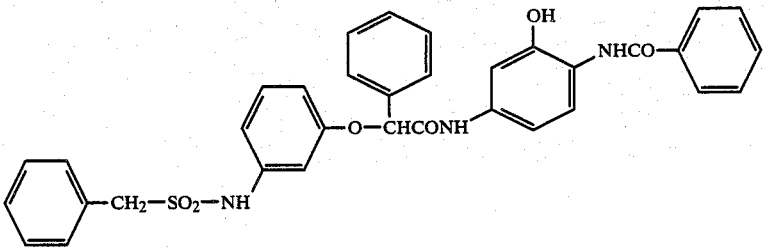
(C-110)
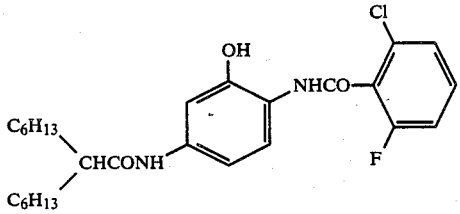

-continued
(C-111)
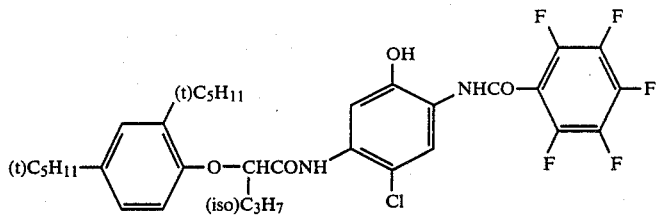
(C-112)
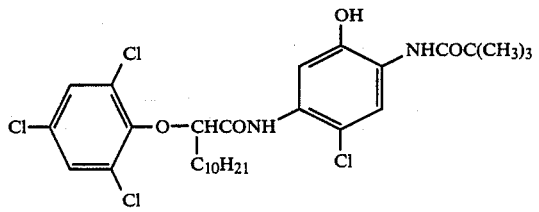
(C-113)
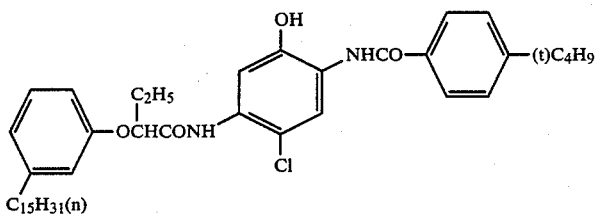
(C-114)
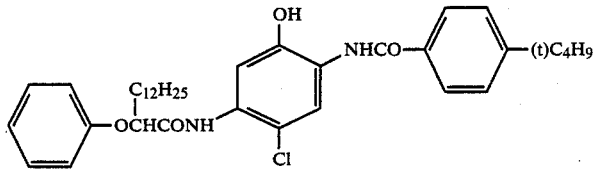
(C-115)
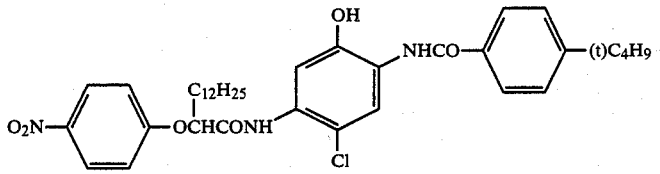
(C-116)
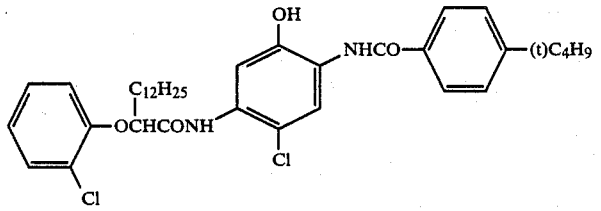
(C-117)
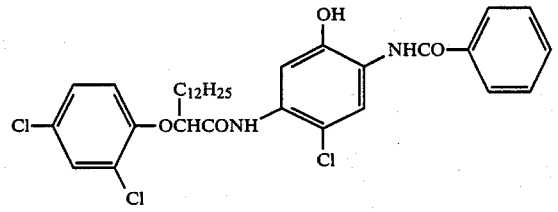

-continued
(C-118)
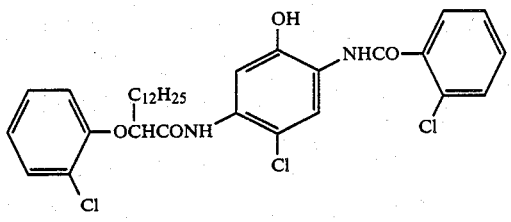
(C-119)
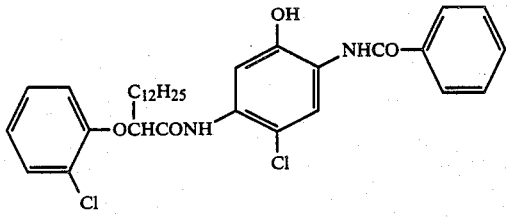
(C-120)
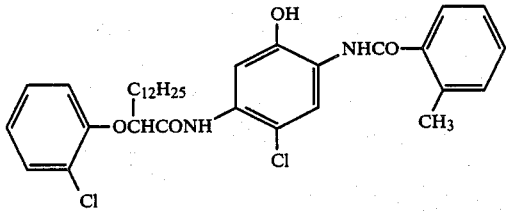
(C-121)
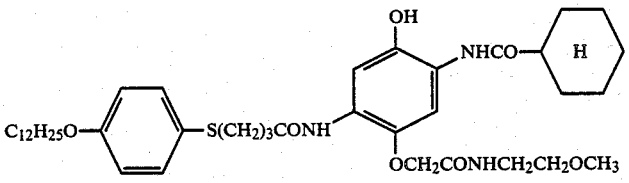
(C-122)
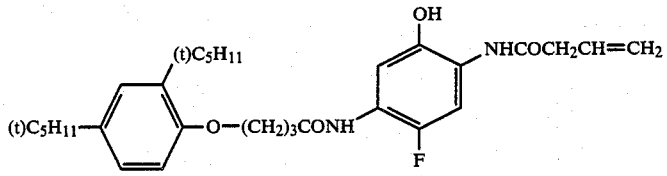
(C-123)
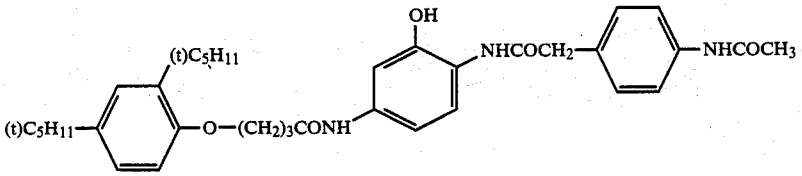
(C-124)
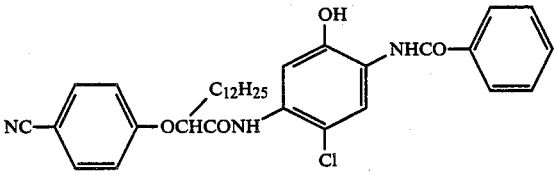
(C-125)
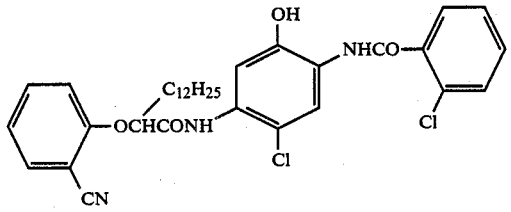

-continued (C-126)

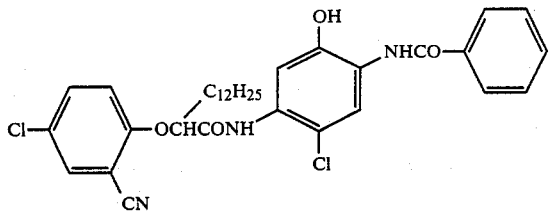

(C-127)

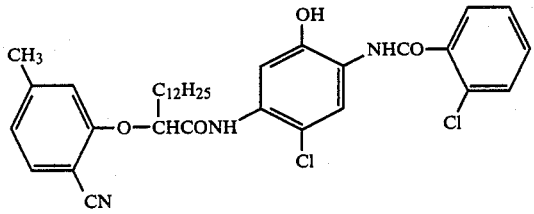

These cyan couplers may be synthesized by the known method. For example, the compound represented by the general formula [C-II] may be synthesized by the methods described in U.S. Pat. Nos. 3,222,176, 3,446,622, and 3,996,253, and British Pat. No. 1,011,940. The compounds represented by the general formula [C-III] may be synthesized by the methods described in U.S. Pat. Nos. 2,772,162, 3,758,308, 3,880,661, and 4,124,396, British Pat. Nos. 975,773, 8,011,693, and 8,011,694, Japanese Unexamined Patent Publication Nos. 47-21139, 50-112038, 55-163537, 56-29235, 55-99341, 56-116030, 52-69329, 56-55945, 56-80045, and 50-134644, British Pat. No. 1,011,940, U.S. Pat. Nos. 3,446,622 and 3,996,253, Japanese Unexamined Patent Publication Nos. 56-65134, 57-204543, 57-204544 and 57-204545, Japanese Patent Application Nos. 56-131309, 56-131311, 56-131314, 56-130459, and 57-149791, and Japanese Unexamined Patent Publication Nos. 59-146050, 59-166956, 60-24547, 60-35731 and 60-37557.

The cyan coupler represented by the general formula [C-I], [C-II] or [C-III] may be used in combination with any other cyan couplers within the scope of the objects of the present invention. It is also possible to use independently or as a combination of two or more of the cyan couplers represented by the general formulas [C-I], [C-II] and [C-III].

When the cyan couplers represented by the general formulas [C-I] to [C-III] are contained in the silver halide emulsion, they are normally used in a proportion within the range of approximately 0.005 to 2 mols per mol of silver halide, preferably within the range of 0.01 to 1 mol per mol of silver halide.

In the present invention, it is preferable that bromide ions are contained in the processing solution in a proportion of $0.7\times10^{-2}$ to $3.5\times10^{-2}$ mols/l. In this case, the objects of the present invention is well accomplished, and further fogging does not arise during high activity development.

The bromide ions are normally supplied in the form of potassium bromide, sodium bromide, lithium bromide or the like.

In the method of processing a photographic material in accordance with the present invention, it is possible to use the processing solution of the present invention. Besides the bath processing, it is possible to use various other methods, for example, spray method in which the processing solution is applied as spray, web method in which the photographic material is contacted with a carrier impregnated with the processing solution, or developing method using a viscous processing solution.

Also, the method of processing the photographic material in accordance with the present invention is not limited, and every processing method may be applied. For example, bleach-fixing may be conducted after color development, and then washing and/or stabilizing may be conducted if necessary. Or, bleaching and fixing may be conducted independently after color development, and then washing and/or stablizing may be conducted if necessary. Or, processing may be conducted in the sequence of pre-hardening, neutralizing, color development, stop-fixing, washing, bleaching, fixing, washing, post-hardening, and washing. Alternatively, processing may be conducted in the sequence of color development, washing, supplementary color development, stopping, bleaching, fixing, washing, and stabilizing. Or, developed silver generated by color development may be subjected to halogenation bleaching, and color development may be conducted again to increase the amount of the generated dye.

The processing solution used in the present invention may further contain various constituents, which are ordinarily added, for example, an alkali agent such as sodium hydroxide or potassium carbonate, an alkali metal sulfite, an alkali metal bisulfite, an alkali metal thiocyanate, an alkali metal halide, benzyl alcohol, water softening agent, a thickening agent, and a development accelerator.

The processing solution may further contain other additives, for example, a development restrainer such as alkali iodide, nitrobenzoimidazole, mercaptobenzoimidazole, 5-methyl-benzotriazole, or 1-phenyl-5-mercaptotetrazole, an anti-staining agent, an anti-sludge agent, a preservative, an interlayer effect accelerating agent, and a chelating agent.

As the bleaching agent used in the bleaching solution in the bleaching process or the bleach-fixing solution, there are generally known an aminopolycarboxylic acid, and an organic acid such as oxalic acid or citric acid, which have coordinated metal ion such as iron, cobalt or copper. Typical examples of aminopolycarboxylic acid are shown below.

Ethylenediamine tetraacetic acid
Diethylenetriamine pendaacetic acid
Propylenediamine tetraacetic acid
Nitrilo triacetic acid
Imino diacetic acid
Glycol ether diamine tetraacetic acid
Ethylenediamine tetrapropionic acid
Ethylenediamine tetraacetic acid disodium salt
Diethylenetriamine pentaacetic acid pentasodium salt
Nitrilo triacetic acid sodium salt The bleaching solution may contain various additives besides the bleaching agent. When a bleach-fixing solution is used in the bleaching process, solution containing a silver halide fixing agent besides the aforesaid bleaching agent is used. The bleach-fixing solution may further contain a halide such as potassium bromide. Like the bleaching solution, the bleach-fixing solution may be added with various other additives, for example, a buffering agent, a brightening agent, an anti-foaming agent, a surface active agent, a preservative, a chelating agent other than those in accordance with the present invention, a stabilizer, and an organic solvent.

The silver halide fixing agent may, for example, be a compound used in ordinary fixing and capable of forming a water-soluble silver salt by reaction with silver halide, such as sodium thiosulfate, ammonium thiosulfate, potassium thiocyanate, sodium thiocyanate, thiourea or thioether.

The processing temperatures in various processes other than the color development of the silver halide color photographic material in accordance with the present invention, for example, bleach-fixing (or bleaching and fixing), washing, and stabilizing, should preferably be 30° C. or higher for achieving quick processing.

In the present invention, the silver halide color photographic material may be subjected to the stabilizing process which substitutes washing, as described in Japanese Unexamined Patent Publication Nos. 58-14834, 58-105145, 58-134634, and 58-18631, and Japanese Patent Application Nos. 58-2709 and 59-89288.

The photographic constituent layers of the silver halide color photographic material in the present invention may be added with a dye (AI dye) which is soluble in water or decolored with the processing solution, such as oxonol dye, hemioxonol dye, melocyanine dye, or azo dye, among which oxonol dye, hemioxonol dye and melocyanine dye are preferable. Examples of the AI dye which may be used are described in British Pat. Nos. 584,609 and 1,277,429, Japanese Unexamined Patent Publication Nos. 48-85130, 49-99620, 49-114420, 49-129537, 52-108115, 59-25845, 59-111640, and 59-111641, U.S. Pat. Nos. 2,274,782, 2,533,472, 2,956,879, 3,125,448, 3,148,187, 3,177,078, 3,247,127, 3,260,601, 3,540,887, 3,575,704, 3,653,905, 3,718,472, 4,071,312, and 4,070,352.

The amount of the AI dyes added should preferably be $2\times10^{-3}$ to $5\times10^{-1}$ mol per mol of silver in the emulsion layer, more preferably $1\times10^{-2}$ to $1\times10^{-1}$ mol per mol of silver.

Crystals of the silver halide grains may be normal or twin or others, and the ratio of the [1.0.0] face to the [1.1.1] face may be of any value. Also, the crystal structure of the silver halide grains may be uniform from the inside to the outside, or the inside and the outside may be of different layer configurations (core shell type). The silver halide may be of the type forming a latent image mainly on the surface or inside of the grains. It is also possible to use flat plate-like silver halide grains as described in Japanese Unexamined Patent Publication No. 58-113934 and Japanese Patent Application No. 59-170070.

Silver halide grains which are particularly preferably used in the present invention are substantially monodisperse, and may be prepared by the acidic method, the neutral method, the ammonia method, or the like.

Also, for example, seed grains may be prepared by the acidic method and made to grow by the ammonia method, which realizes a high growth rate, up to a predetermined size. When making the silver halide grains grow, the pH value, the pAg value, or the like in the reaction vessel should be controlled, and silver ion and halide ion should be simultaneously added in amounts suitable for the growth rate of the silver halide grains, as described in Japanese Unexamined Patent Publication No. 54-48521.

Preparation of the silver halide grains in the present invention should preferably be conducted as described above. The composition containing the silver halide grains is herein referred to as the silver halide emulsion.

The silver halide emulsion may be chemically sensitized with active gelatine; a sulfur sensitizer such as alyl thiocarbamide, thiourea or cystine; a selenium sensitizer; a reducing sensitizer such as a stannous salt, thiourea dioxide or a polyamine; a noble metal sensitizer such as gold sensitizer, specifically potassium aurithiocyanate, potassium chloroaurate, 2-aurothio-3-methylbenzothiazolium chloride, or a water-soluble salt of ruthenium, paradium, platinum, rodium or iridium, specifically ammonium chloroparadate, potassium chloroplatinate or sodium chloroparadate (some of these act as a sensitizer or a fogging restrainer depending on the amount). These sesitizers may be used independently or in combination with each other, for example, as a combination of the gold sensitizer and the sulfur sensitizer, or a combination of the gold sensitizer and selenium sensitizer.

In the general invention, the silver halide emulsion may be added with a sulfur-containing compound, and chemically ripened. Prior to, during or after the chemical ripening, the silver halide emulsion may be added with at least one hydroxytetrazaindene and at least one nitrogen-containing heterocyclic compound containing a mercapto group.

In order to impart sensitivity to a desired sensitivity wavelength range, silver halide used in the present invention may be optically sensitized by the addition of a sensitizing dye outside of the scope of the present invention in a proportion of $5\times10^{-8}$ to $3\times10^{-3}$ mol per mol of silver halide. As the sensitizing dye outside of the scope of the present invention, various dyes may be used independently or as a combination of two or more dyes.

The red-sensitive silver halide emulsion layer in the present invention contains the aforesaid cyan coupler in accordance with the present invention, and may also contain a cyan coupler outside of the scope of the present invention. However, the amount of the cyan coupler outside of the scope of the present invention should preferably be less than 50 mol% with respect to the total amount of the cyan couplers. The blue-sensitive silver halide emulsion layer and the green-sensitive silver halide emulsion layer in the present invention may be added with a coupler, i.e. a compound capable of forming a dye by reaction with the oxide of the color developing agent.

Yellow couplers effectively used in the present invention are an open chain ketomethylene compound, and 2-equivalent couplers, for example, a coupler in which the active point is substituted by an o-aryl group, a coupler in which the active point is substituted by an o-acyl group, a coupler in which the active point is substituted by a hydantoin compound, a coupler in which the active point is substituted by an urazol compound and a coupler in which the active point is substituted by a succinic acid imide compound, a coupler in which the active point is substituted by fluorine, a coupler in which the active point is substituted by chlorine or bromine, and a coupler in which the active point is substituted by an o-sulfonyl group. Typical examples of the yellow coupler usable in the present invention are described in U.S. Pat. Nos. 2,875,057, 3,265,506, 3,408,194, 3,551,155, 3,582,322, 3,725,072 and 3,891,445, West Germany Pat. No. 1,547,868, West Germany OLS 2,219,917, 2,261,361, and 2,414,006, British Pat. No. 1,425,020 Japanese Patent Publication No. 51-10783, Japanese Unexamined Patent Publication Nos. 47-26133, 48-73147, 51-102636, 50-6341, 50-123342, 50-130442, 51-21827, 50-87650, 52-82424, 52-115219, and 58-95346.

Magenta couplers usable in the present invention are a pyrazolone compound, a pyrazolotriazole compound, pyrazolinobenzimidazole compound, and an indazolone compound. These magenta couplers may be 4-equivalent or 2-equivalent like the yellow coupler. Examples of the magenta coupler usable in combination are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, and 3,891,445, West Germany Pat. No. 1,810,464, West Germany OLS 2,408,665, 2,417,945, 2,418,959, and 2,424,467, Japanese Patent Publication No. 40-6031, Japanese Unexamined Patent Publication Nos. 51-20826, 52-58922, 49-129538, 49-74027, 50-159336, 52-42121, 49-74028, 50-60233, 51-26541, and 53-55122, and Japanese Patent Application No. 55-110943.

Phenol couplers and naphthol couplers outside of the scope of the present invention may also be used as the cyan couplers usable in combination in the present invention. These cyan couplers may be 4-equivalent or 2-equivalent like the yellow coupler. Examples of the cyan couplers usable in combination are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494, and 4,004,929, West Germany OLS 2,414,830, and 2,454,329, Japanese Unexamined Patent Publication Nos. 48-59838, 51-26034, 48-5055, 51-146827, 52-69624, 52-90932, and 58-95346, and Japanese Patent Publication No. 49-11572.

The silver halide emulsion layer and other photographic constituent layers in the present invention may also contain a non-diffusing DIR compound, a colored magenta or cyan coupler, a polymer coupler, and a diffusing DIR compound. The non-diffusing DIR compound and the colored magenta or cyan coupler are described in Japanese Patent Application No. 59-193611, and the polymer coupler is described in Japanese Patent Application No. 59-172151.

Though the addition amount of the aforesaid couplers usable in the present invention is not limited, it should preferably be $1\times10^{-3}$ to 5 mols per mol of silver, more preferably be $1\times10^{-2}$ to $5\times10^{-1}$ mols per mol of silver.

When the cyan coupler in accordance with the present invention is soluble in an alkali, the cyan coupler or the like in accordance with the present invention may be added as an alkaline solution to the silver halide emulsion. When the cyan coupler is soluble in an oil, the cyan coupler in accordance with the present invention should be dissolved in a high boiling point solvent, if necessary, with a low boiling point solvent, and dispersed as fine grains in the silver halide emulsion as described, for example, in U.S. Pat. Nos. 2,322,027, 2,801,170, 2,801,171, 2,272,191 and 2,304,940. At this time, other hydroquinone derivatives, ultraviolet ray absorbers, anti-fading agents, or the like may also be used. It is also possible to use a mixture of two or more of the cyan couplers in accordance with the present invention. The preferable method of adding the cyan coupler in accordance with the present invention will be described below in detail. First, one or more cyan couplers in accordance with the present invention are dissolved, together with other couplers, hydroquinone derivatives, anti-fading agents, ultraviolet ray absorber, if necessary, in a high boiling point solvent such as an organic acid amide, a carbamate, an ester, a ketone, a urea derivative, an ether, a hydrocarbon, particularly di-n-butyl phthalate, tri-cresyl phosphate, triphenyl phosphate, di-isooctyl acelate, di-n-butyl sebacate, tri-n-hexyl phosphate, N,N-di-ethyl-caprylamide butyl, N,N-diethyl-laurylamide, n-pentadecyl phenyl ether, di-octyl phthalate, n-nonyl phenol, 3-pentadecyl phenyl ethyl ether, 2,5-di-sec-amyl phenyl butyl ether, monophenyl-di-o-chlorophenyl phosphate, or fluorine paraffin, and/or a low boiling point solvent such as methyl acetate, ethyl acetate, propyl acetate, butyl acetate, butyl propionate, cyclohexanol, diethylene glycol monoacetate, nitromethane, carbon tetrachloride, chloroform, cyclohexane tetrahydrofuran, methyl alcohol, acetonitrile, dimethyl formamide, dioxane, or methyl ethyl ketone. The solution is mixed with an aqueous solution containing an anionic surface active agent such as alkylbenzenesulfonic acid or alkylnaphthalenesulfonic acid, and/or a nonionic surface active agent such as sorbitan sesquioleic acid ester or sorbitan monolauric acid ester, and/or a hydrophilic binder such as gelatine.

The mixture is subjected to emulsification and dispersion using a high-speed rotary mixer, a colloid mill or an ultrasonic dispersing machine, and then added to the silver halide emulsion.

The aforesaid couplers or the like may also be dispersed by the latex dispersion method. The latex dispersion method and its effects are described in Japanese Unexamined Patent Nos. 49-74538, 51-59943 and 54-32552, and Research Disclosure, August 1976, No. 14850, pp 77–79.

Suitable latex is, for example, a homopolyer, a copolymer or a terpolymer of monomers such as styrene, acrylate, n-butyl acrylate, n-butyl methacrylate, 2-aceto acetoxy ethyl methacrylate, 2-(methacryloyloxy)ethyl trimethyl ammonium metho-sulfate, 3-(methacryloyloxy) propane-1-sulfonic acid sodium salt, N-isopropyl acrylamide, N-[2-(2-methyl-4-oxopentyl)] acrylamide, and 2-acrylamide-2-methylpropane sulfonic acid.

In the present invention, the silver halide color photographic material may be added with various photographic additives, for example, anti-foggants, stabilizers, ultraviolet ray absorbers, anti-staining agents, brightening agents, anti-fading agents, anti-static agents, hardeners, surface active agents, plasticizers, and wetting agents, as described in Research Disclosure, No. 17643.

The hydrophilic colloid used for the preparation of the emulsion in the silver halide color photographic material in the present invention may embraces gelatine, derivative gelatine, graft polymer of gelatine with other high molecular weight material, protein such as albumin or casein, a cellulose derivative such as hydroxy ethyl cellulose derivative or carboxy methyl cellulose, a starch derivative, and a synthetic hydrophilic high molecular weight material such as the monomer or copolymer of polyvinyl alcohol, polyvinyl imidazole, and polyacrylamide.

The substrate of the silver halide color photographic material may, for example, be Baryta paper, polyethylene covered paper, polypropyrene synthetic paper, a transparent substrate provided with a reflection layer or used together with a reflector, such as a glass plate, a polyester film such as cellulose acetate, cellulose nitrate or polyethylene terephthalate, a polyamide film, a polycarbonate film, a polystyrene film, or other ordinary transparent substrate. The substrate is selected in accordance with the purpose of using the photographic material.

For the application of the silver halide emulsion layer and other photographic constituent layers, it is possible to use various coating methods such as dip coating, air doctor coating, curtain coating, and hopper coating. It is also possible to use the simultaneous coating for two or more layers as described U.S. Pat. Nos. 2,761,791 and 2,941,898.

In the present invention, the positions of the emulsion layers may be selected arbitrarily. For example, in the case of a photographic material for full-color photographic paper, the blue-sensitive silver halide emulsion layer, the green-sensitive silver halide emulsion layer, and the red-sensitive silver halide emulsion layer may be positioned in this sequence starting from the substrate side. Each of these sensitive silver halide emulsion layers may be constituted by two or more layers. The effects of the present invention become large when all of these sensitive emulsion layers substantially consist of a silver chloride bromide emulsion.

In the present invention, the photographic material may be provided with intermediate layers having a thickness appropriate for the purposes. Further, various layers such as a filter layer, an anti-curling layer, a protective layer and an anti-halation layer may be added as the constituent layers. In these constituent layers, the aforesaid hydrophilic colloid, which may be used in the emulsion layers, may be used as a binder, and the aforesaid various photographic additives which may be contained in the emulsion layers may be added.

The compound represented by the general formula [II] may be contained in the silver halide color photographic material so that it dissolves during processing and is present in the processing solution at the aforesaid concentration.

In the present invention, generation of stains at the unexposed sections is prevented or eliminated, and consistent photographic performance is obtained regardless of differences in stirring capacity between automatic developing machines. Also, when the processing method in accordance with the present invention is conducted with an automatic developing machine having a color development processing bath having an opening ratio of 7 to 200 $cm^2/l$, it is possible to prevent staining arising at the liquid boundary in the color development processing bath due to evaporation, and generation of stains at the unexposed sections are prevented or eliminated even though the bleach-fixing is directly carried out during non-continuous processing with low replenishment (particularly, magenta staining is eliminated).

In this case, the following requirements should preferably be satisfied: (1) the opening ratio of the color development processing bath should be 12 to 150 $cm^2/l$, (2) the opening ratio of the color development processing bath should be 16 to 120 $cm^2/l$, (3) the processing temperature of the processing solution should be 35° C. or higher, and (4) the replenishing rate of the processing solution during continuous processing of the color photographic material should be 260 $ml/m^2$ or less.

By "opening area of a color development processing bath in an automatic-developing machine used for continuous processing" is meant the area of the opening section of the processing bath, which generally corresponds to the area of the processing composition contacting air.

In the present invention, the opening area of the color development processing bath (air-contacting area) is adjusted to 7 to 200 $cm^2$ per liter of the aqueous processing solution, preferably 12 to 150 $cm^2$ more preferably 16 to 120 $cm^2$.

A preferable method for controlling the opening area (air-contacting area) is to use a (spheric) float made of a plastic material or the like and capable of covering the surface of the processing solution.

In the present invention, by the control of the opening area (air-contacting area), accumulation of the oxide of the color developing agent is prevented efficiently, and staining and entry of the liquid to other processing solutions due to liquid scattering are prevented. The control of the opening area is particularly advantageous in the case where daily processing finishes within short time, i.e. the processing time of the automatic developing machine is very short and the stop time is long (only temperature control is performed during stopping). Specifically, it is advantageous when the actual processing time in continuous processing of the automatic developing machine is within 6 hours per day (24 hours), more preferably within 4 hours per day.

The present invention will further be illustrated by the following nonlimitative examples.

EXAMPLE 1

An experiment was conducted by using the following basic processing solution.

| (Processing solution) | |
|---|---|
| Potassium carbonate | 30 g |
| Benzyl alcohol | 17 ml |
| Ethylene glycol | 15 ml |
| Potassium sulfite | 2 g |
| Hydroxylamine sulfate | 3 g |
| 3-methyl-4-amino-N—ethyl-N—(β-methanesulfonamide ethyl)-aniline sulfate | 8 g |
| Potassium hydroxide | 2 g |

This composition was made up to 1 l with water, and the pH value was adjusted to 10.6 by use of potassium hydroxide or 20% sulfuric acid.

The processing solution thus obtained was used as a control sample, added with a chelating agent listed in Table 1 and a surface active agent [(I-1), 0.1 g/l], and equally divided into two portions.

When the pH value of the processing solution changed due to the addition of the chelating agent and the surface active agent, the pH value was adjusted to 10.6 by use of potassium hydroxide or 20% sulfuric acid.

One portion of the processing solution was introduced into a soft polyvinyl chloride hose, stored at 3° C. for 10 days, and the condition of crystal deposition (low-temperature deposition) was observed. The other portion was introduced into a 500 ml hard polyvinyl chloride vessel having an opening area of 100 $cm^2$, stored at 40° C. and humidity of 10% RH for 10 days, the crystal deposition condition (evaporation deposition) at the evaporation boundary was observed, and the difference in pH value between the stages before and after the storing was measured.

The results are shown in Table 1.

TABLE 1

| Experiment No. | Chelating agent (2 g/l) | Surface active agent | Surface tension (dyne/cm) | Low temperature deposition | Evaporation deposition | Difference in pH |
|---|---|---|---|---|---|---|
| 1 (In accordance with present invention) | (IX-1) | (I-1) | 31 | o | o | −0.12 |
| 2 (In accordance with present invention) | (VIII-2) | (I-1) | 31 | o | o | −0.14 |
| 3 (In accordance with present invention) | (IX-3) | (I-1) | 31 | o | o | −0.15 |
| 4 (In accordance with present invention) | (IX-5) | (I-1) | 30 | o | o | −0.12 |
| 5 (In accordance with present invention) | (VIII-8) | (I-1) | 32 | o | o | −0.13 |
| 6 (Comparative) | (VIII-8) | No addition | 70 | x | x | −0.22 |
| 7 (Comparative) | No addition | (I-1) | 32 | o | x | −0.28 |
| 8 (Comparative) | Sodium polyphosphate | (I-1) | 31 | o | x | −0.25 |
| 9 (Comparative) | Sodium citrate | (I-1) | 31 | o | x | −0.23 |
| 10 (Comparative) | Sodium citrate | No addition | 71 | x | x | −0.35 |
| 11 (Comparative) | No addition | No addition | 71 | xx | x | −0.31 |

In Table 1, the mark "o" indicates that no crystal deposition arose and the result was good. The mark "x" indicates that crystal deposition arose slightly, and the mark "xx" indicates that crystal deposition arose to a large extent.

As clear from Table 1, only when the chelating agent in accordance with the present invention is used and the surface tension is within the range in accordance with the present invention, deposition at low temperatures does not arise, crystal deposition during evaporation does not arise, and drop in pH value is minimized.

When the chelating agent and the surface tension as defined in the present invention are used independently, low temperature deposition arises, the pH value drops greatly, and evaporation deposition arises.

EXAMPLE 2

Experiments were conducted in the same manner as Example 1, except that the addition amount of the surface active agent (I-1) in Experiment No. 1 in Example 1 was changed, and the surface tension of the processing solution was adjusted as shown in Table 2.

TABLE 2

| | Surface tension (dyne/cm) | Low temperature deposition | Evaporation deposition |
|---|---|---|---|
| 12 (Comparative) | 16 | x | Δ |
| 13 (In accordance with present invention) | 20 | o | Δ |
| 14 (In accordance with present invention) | 25 | o | o |
| 15 (In accordance with present invention) | 30 | o | o |
| 16 (In accordance with present invention) | 42 | o | o |
| 17 (In accordance with present invention) | 50 | o | Δ |
| 18 (In accordance with present invention) | 60 | o | Δ |
| 19 (Comparative) | 70 | x | x |
| 20 (Comparative) | 73 | xx | x |

In Table 2 the mark "o" indicates that no crystal deposition arose and the result was good, and the mark "Δ" indicates that crystal deposition arose slightly though no actual problem arose. The mark "x" indicates that crystal deposition arose to an unacceptable level, and the mark "xx" indicates that crystal deposition arose to a large extent.

As clear from Table 2, low temperature deposition and evaporation deposition are prevented when the surface tension is within the range of 20 to 60 dynes/cm. The results are very good when the surface tension is within the range of 25 to 42 dynes/cm.

EXAMPLE 3

Instead of the surface active agent (I-1) used in Example 1, (I-12) and (I-13) were used to obtain the same surface tension. Then, experiments were conducted in the same manner as Example 1, and the same results as in Example 1 were obtained.

EXAMPLE 4

Experiments were conducted in the same manner as Example 1, except that the surface active agents (IV-3), (III-1), (II-2) and (II-10) were added in a proportion of 0.1 g/l to the processing solution of Experiment No. 3 in Example 1. Thus the same results as in Experiment No. 3 in Example 1 were obtained. Also, when the surface active agents (IV-3), (III-1), (II-2) and (II-10) were added, the degree of coloring of the processing solution was lower than when they were not added.

EXAMPLE 5

Experiments were conducted in the same manner as Example 1, except that ethylene glycol in the processing solution in Example 1 was omitted. In this case, the low temperature deposition characteristics and the evaporation deposition characteristics were deteriorated. Further, longer time was required for dissolution of the processing solution.

When the same experiments were conducted by replacing ethylene glycol by the same amount of diethylene glycol and triethanolamine, the dissolution characteristics and the pH stability of the processing solution were further improved.

EXAMPLE 6

Potassium bromide was added to the processing solution of Example 1 by increasing the addition amount like $1\times10^{-3}$ mols/l, $2\times10^{-3}$ mols/l, $3\times10^{-3}$ mols/l, . . . , and experiments were conducted in the same manner as Example 1. When the addition amount was $2\times10^{-3}$ mols/l or less, the evaporation deposition preventing characteristics were particularly good.

EXAMPLE 7

Experiments were conducted in the same manner as Example 1, except that 3-methyl-4-amino-N-ethyl-N-(β-methanesulfoneamide ethyl)-aniline sulfate was replaced by 3-methyl-4-amino-N,N-diethylaniline hydrochloride. The low temperature deposition, evaporation crystal deposition, and solubility of the processing solution were deteriorated slightly.

EXAMPLE 8

A photographic material was prepared by applying the layers onto a polyethylene coated paper substrate in the sequence starting from the substrate side.

The polyethylene coated paper was prepared by adding 6.8 wt.% of anatase type titanium oxide to a mixture of 200 parts by weight of polyethylene having an average molecular weight of 100,000 and a density of 0.95 with 20 parts by weight of polyethylene having an average molecular weight of 2,000 and a density of 0.80, forming a 0.035-mm thick covering layer on a surface of wood free paper having a weight of 170 g/m$^2$ by extrusion coating method, and applying a 0.040-mm thick polyethylene covering layer to the rear surface. The polyethylene covering layer of this substrate was subjected to corona discharging pre-treatment, and then the layers listed below are applied sequentially.

First layer:

The first layer was a blur-sensitive silver halide emulsion layer consisting of a silver chloride bromide containing 95 mol % of silver bromide. This emulsion contained gelatine in a proportion of 350 g per mol of silver halide, was sensitized with $2.5\times10^{-4}$ mols of a sensitizing dye (a) having the configuration described below per mol of silver halide (isopropyl alcohol was used as the solvent). It also contained 2,5-di-t-butylhydroquinone dispersed in the compound (A-9), and α-[4-(1-benzyl-2-phenyl-3,5-dioxo-1,2,4-triazolyl)]-α-pivalyl-2-chloro-5-[γ-(2,4-di-t-amylphenoxy)-butylamide]acetoanilide as the yellow coupler in a proportion of $2\times10^{-1}$ mols per mol of silver halide, and was applied so that the silver amount was 330 mg/m$^2$.

Second layer:

The second layer was a gelatine layer containing 290 mg/m$^2$ of di-t-octylhydroquinone dissolved in compound (A-9) and dispersed, and 200 mg/m$^2$ of a mixture as an ultraviolet ray absorber containing 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chloro-benzotriazole, and 2-(2'-hydroxy-3',5'-di-t-butylphenyl)-5-chloro-benzotriazole at a ratio of 1:1:1:1. This layer was applied so that the gelatine amount was 2,000 mg/m$^2$.

Third layer:

The third layer was a green-sensitive silver halide emulsion layer consisting of a silver chloride bromide emulsion containing 85 mol% of silver bromide. This emulsion contained 450 g of gelatine per mol of silver halide, and was sensitized with the sensitizing dye listed in Table 1 in a proportion of $2.5\times10^{-4}$ mols per mol of silver halide. The emulsion also contained 2,5-di-t-butylhydroquinone dissolved and dispersed in a solvent containing the compound (A-9) and compound (A-25) at a ratio of 2:1, and 1-(2,4,6-trichlorophenyl)-3-(2-chloro-5-octadecenylsuccinimideanilino)-5-pyrazolone as the magenta coupler in a proportion of $1.5\times10^{-1}$ mols per mol of silver halide. The emulsion was applied so that the silver amount was 300 mg/m$^2$. As the antioxidant, 2,2,4-trimethyl-6-lauryloxy-7-t-octylchroman was used in a proportion of 0.3 mols per mol of the coupler.

Fourth layer:

The second layer was a gelatine layer containing 30 mg/m$^2$ of di-t-octylhydroquinone dissolved in compound (A-9) and dispersed, and 500 mg/m$^2$ of a mixture as an ultraviolet ray absorber containing 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chloro-benzotriazole, and 2-(2'-hydroxy-3',5'-di-t-butylphenyl)-5-chlorobenzotriazole at a ratio of 2:1.5:1.5:2. This layer was applied so that the gelatine amount was 2,000 mg/m$^2$.

Fifth layer:

The third layer was a red-sensitive silver halide emulsion layer consisting of a silver chloride bromide emulsion containing 85 mol% of silver bromide. This emulsion contained 500 g of gelatine per mol of silver halide, and was sensitized with the sensitizing dye (b) having the configuration shown below in a proportion of $2.5\times10^{-4}$ mols per mol of silver halide. The emulsion also contained 2,5-di-t-butylhydroquinone dissolved and dispersed in the compound (A-9), and 2,4-dichloro-3-methyl-6-[γ-(2,4-diamylphenoxy)butylamide]phenol as the cyan coupler in a proportion of $3.5\times10^{-1}$ mols per mol of silver halide. The emulsion was applied so that the silver amount was 300 mg/m$^2$.

Sixth layer:

This layer was a gelatine layer and was applied so that the gelatine amount was 1,000 mg/m$^2$.

The silver halide emulsions used in the photographic emulsion layers (first, third and fifth layers) were prepared by the method described in Japanese Patent Publication No. 46-7772, chemically sensitized with sodium thiosulphate pentahydrate, and added with 4-hydroxy-6-methyl-1,3,3a,7-tetrazaindene as a stabilizer (2.5 g per mol of silver halide), bis(vinylsulfomethyl)ether as a hardener (10 mg per 1 g of gelatine), and saponine as a coating auxiliary.

Sensitizing dye (a)

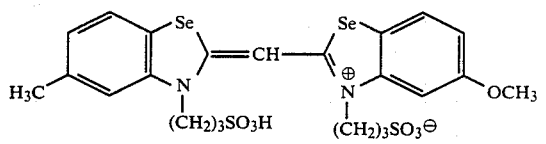

Sensitizing dye (b)

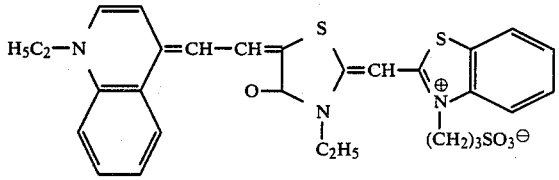

The color paper prepared as described above was exposed and subjected to continuous processing using the processes and processing solutions shown below.

Standard treatment process

| | | |
|---|---|---|
| (1) Color developing | 38° C. | 3 min. 30 sec. |
| (2) Bleach-fixing | 38° C. | 1 min. 30 sec. |
| (3) Stabilizing | 25° C. to 35° C. | 3 min. |
| (4) Drying | 60° C. to 80° C. | Approx. 2 min. |

Composition of processing solution

[Color developing tank solution]

| | |
|---|---|
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 30.0 g |
| Compound (E-1) sulfate | 5.5 g |
| Compound (A-2) | 1.0 g |
| Hydroxylamine sulfate | 3.0 g |
| 1-hydroxyethylidene-1,1-diphosphonic acid | 0.4 g |
| Magnesium chloride hexahydrate | 0.7 g |
| 1,2-dihydroxybenzene-3,5-disulfonic acid disodium salt | 0.2 g |

The solution was made up to 1 l with water, and the pH value was adjusted to 10.20 with potassium hydroxide and sulfuric acid.

[Color development replenishing solution]

| | |
|---|---|
| Benzyl alcohol | 20 ml |
| Ethylene glycol | 20 ml |
| Potassium sulfite | 3.0 g |
| Potassium carbonate | 30.0 g |
| Hydroxylamine sulfate | 4.0 g |
| Compound (E-1) sulfate | 7.5 g |
| Compound (A-2) | 2.5 g |
| 1-hydroxyethylidene-1,1-diphosphonic acid | 0.5 g |
| Magnesium chloride hexahydrate | 0.8 g |
| 1,2-dihydroxybenzene-3,5-disulfonic acid disodium salt | 0.3 g |

The solution was made up to 1 l with water, and the pH value was adjusted to 10.70 with potassium hydroxide.

[Bleach-fixing tank solution]

| | |
|---|---|
| Ethylenediaminetetraacetic acid ferric ammonium dihydrate salt | 60.0 g |
| Ethylenediaminetetraacetic acid | 3.0 g |
| Ammonium thiosulfate (70% solution) | 100.0 ml |
| Ammonium sulfite (40% solution) | 27.5 ml |

The solution was made up to 1 l with water, and the pH value was adjusted to 7.1 with potassium carbonate or glacial acetic acid.

[Bleach-fixing replenishing solution A]

| | |
|---|---|
| Ethylenediaminetetraacetic acid ferric ammonium dihydrate salt | 260.0 g |
| Potassium carbonate | 42.0 g |

The solution was made up to 1 l with water. The pH value of this solution was 6.7±0.1.

[Bleach-fixing replenishing solution B]

| | |
|---|---|
| Ammonium thiosulfate (70% solution) | 500.0 ml |
| Ammonium sulfite (40% solution) | 250.0 ml |
| Ethylenediaminetetraacetic acid | 17.0 g |
| Glacial acetic acid | 85.0 ml |

The solution was made up to 1 l with water. The pH value of this solution was 5.3±0.1.

[Washing-substitute stabilizer tank solution and replenishing solution]

| | |
|---|---|
| 5-chloro-2-methyl-4-isothiazoline-3-on | 0.02 g |
| 2-methyl-4-isothiazoline-3-on | 0.02 g |
| Ethylene glycol | 1.0 g |
| 2-octyl-4-isothiazoline-3-on | 0.01 g |
| 1-hydroxyethylidene-1,1-diphosphonic acid (60% aqueous solution) | 3.0 g |
| $BiCl_3$ (45% aqueous solution) | 0.65 g |
| $MgSO_4.7H_2O$ | 0.2 g |
| Ammonia water (Aqueous 25% ammonium hydroxide) | 2.5 g |
| Nitrilotriacetic acid trisodium salt | 1.5 g |

The solution was made up to 1 l with water, and the pH value was adjusted to 7.0 with sulfuric acid.

The aforesaid color development tank solution, the bleach-fixing tank solution, and the stabilizer tank solution were filled in an automatic developing machine. While the aforesaid color paper sample was processed, the color development replenishing solution, the bleach-fixing replenishing solutions A and B, and the stabilizing replenishing solution were added with metering cups at 3-minute intervals, and a running test was conducted in this manner. The replenishing amount to the color development tank was 190 ml per 1 $m^2$ of the color paper, the replenishing amount of each of the bleach-fixing replenishing solutions A and B to the bleach-fixing tank was 50 ml per 1 $m^2$ of the color paper, and the replenishing amount of the wathing-substitute stabilizing replenishing solution to the stabilizing bath was 250 ml per 1 $m^2$ of the color paper.

The stabilizing baths of the automatic developing machine were composed of a first bath, a second bath, and a third bath positioned in the flow direction of the photographic material. Replenishing was effected from the final bath. The overflow solution from the final bath was introduced into the previous bath and the overflow solution from the previous bath was introduced into the bath preceding to the previous bath (multi-bath countercurrent system).

Continuous processing was conducted until the total amount of the replenished color developing solution became three times the capacity of the color development tank.

In the experiments, the additives shown in Table 1 were added to the color developing solution and the color development replenishing solution in a proportion of 0.1 g/l. The color developing bath of the automatic developing machine was provided with Iwaki Magnet Pump MD-20 for jetting the solution to the color paper emulsion surface and stirring it.

In the experiments, the difference in cyan density at the maximum density section between the cases with and without jet stirring was measured with Optical Densitometer PDA-65 (Konishiroku Photo Industry, Ltd.). Also, the apparent whiteness at the unexposed sections was visually observed. The results were as shown in Table 3.

TABLE 3

| Experiment No. | Sensitizing dye | Additive to color developing solution | Difference in density | Apparent whiteness |
|---|---|---|---|---|
| 1 (Comparative) | D'-1 (Described below) | None | 0.24 | xx |
| 2 (Comparative) | D'-1 (Described below) | I-1 | 0.20 | Δ |
| 3 (Comparative) | D-12 | None | 0.16 | x |
| 4 (In accordance with present invention) | D-12 | I-1 | 0.05 | o |
| 5 (In accordance with present invention) | D-11 | I-1 | 0.07 | o |
| 6 (In accordance with present invention) | D-16 | I-1 | 0.04 | o |
| 7 (In accordance with present invention) | D-12 | I-12 | 0.05 | o |
| 8 (In accordance with present invention) | D-12 | I-13 | 0.06 | o |

Comparative sensitizing dye D'-1

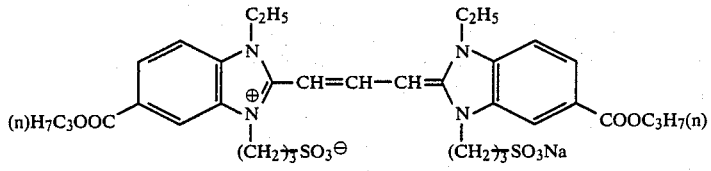

In Table 3, the mark "o" indicates that the apparent whiteness at the unexposed section is good, the mark "Δ" indicates that it is slightly low, and the mark "x" indicates that is is low. Lower apparent whiteness is indicated by increasing the number of the mark "x".

As clear from Table 3, when the sensitizing dye in accordance with the present invention is used in the photographic material and the compound represented by the general formula [I] in accordance with the present invention is used, the sensitometry fluctuation is small even though stirring fluctuates, and the apparent whiteness is high. However, when only the aforesaid sensitizing dye is used or only the aforesaid compound of the general formula [I] is used, the aforesaid effects are not obtained sufficiently.

EXAMPLE 9

Experiments were conducted in the same manner as Example 8, except that the compounds (VIII-2), (VIII-8), (IX-1), (IX-3) and (IX-5) were respectively added in a proportion of 3 g/l to the color developing solution and the color development replenishing solution in Example 8. Better results were obtained with respect to the density difference and apparent whiteness.

EXAMPLE 10

The same color paper as in Example 8 was prepared by replacing the cyan coupler in Example 8 by the compounds (C-2), (C-8) and (C-59), and experiments were conducted in the same manner as Example 8. In this case, the density difference became further smaller, and better results were obtained.

EXAMPLE 11

The dielectric constants of the high boiling point solvents (A-9) and (A-25) used in preparation of the color paper in Example 8 were respectively 6.44 and 7.46. Color paper was prepared in the same manner by replacing the high boiling point solvents by liquid paraffin (dielectric constant: 2.2), and experiments were conducted in the same manner as Example 8. In this case, the adverse effect of stirring fluctuation on the sensitometry increased.

EXAMPLE 12

Experiments were conducted in the same manner by replacing the compound (E-1) sulfate in the color developing solution and the color development replenishing solution in Example 8 by 3-methyl-4-amino-N,N-diethylaniline hydrochloride. In these examples, the apparent whiteness at the unexposed section deteriorated slightly.

We claim:

1. A processing solution for developing a silver halide color photographic material comprising a color developing agent and at least one compound selected from the group consisting of an aminocarboxylic acid and an aminophosphonic acid, said processing development solution having a surface tension ranging from 20 to 60 dynes/cm.

2. The processing solution of claim 1, wherein said aminocarboxylic acid has at least two carboxylic acid groups and said aminophosphonic acid has at least two phosphonic acid groups.

3. The processing solution of claim 1, wherein said aminocarboxylic acid and said aminophosphonic acid have a chemical structure represented by the formula [VIII] or formula [IX];

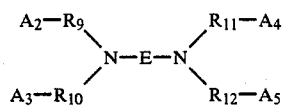

[VIII]

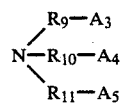

[IX]

wherein E is a radical selected from the group consisting of an alkylene group, a cycloalkylene group and a phenylene group, wherein said radical may be substituted by $—R_{13}OR_{13}OR_{13}—$, $—R_{13}ZR_{13}—$ (wherein, Z represents $>N—R_{13}—A_6$ or $>N—A_6$); $R_9$ to $R_{13}$ independently represent an alkylene group which may be substituted; $A_2$ to $A_6$ are independently selected from the group consisting of a hydrogen atom, —OH, —COOM and $—PO_3M$, wherein M is a hydrogen atom or an alkali metal atom, provided that at least two of $A_2$ to $A_6$ are selected from —COOM or $—PO_3M$.

4. The processing solution of claim 1, wherein said aminopolycarboxylic acid or said aminophosphonic acid is present in an amount of 0.1 to 20 g per liter of said solution.

5. The processing solution of claim 1, wherein said aminocarboxylic acid or said aminophosphonic acid is present in an amount of 0.3 to 5 g per liter of said composition.

6. The processing solution of claim 1, wherein said color developing agent is a p-phenylenediamine compound.

7. The processing solution of claim 1, wherein said solution further comprises a compound represented by the general formula [I];

$$R—O—(A)n—(B)m—C \qquad [I]$$

wherein R is selected from the group consisting of a chained or branched alkyl group having 4 to 25 carbon atoms, in which said alkyl group may be substituted, or a group of the formula

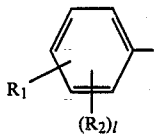

wherein, $R_1$ and $R_2$ are independently selected from the group consisting of a hydrogen atom and an alkyl group having 1 to 20 carbon atoms in which said alkyl group may be substituted, 1 is an integer of 1 to 4 provided that when 1 is 2, 3 or 4, $R_2$ may be either the same or different; A and B independently represent a group represented by the formula

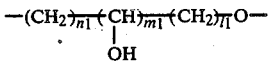

wherein $n_1$, $m_1$ and $l_1$ independently are an integer of 0, 1, 2, or 3 provided that $n_1$, $m_1$ and $l_1$ are not 0 at the same time; and C is selected from a group consisting of hydrogen atom and a group represented by $—SO_3M$, wherein M is selected from the group consisting of hydrogen, sodium, potassium, ammonium and lithium; and n and m are independently an integer of 0 to 25 provided than m and n are not 0 at the same time.

8. The processing solution of claim 1, wherein said solution further comprises a compound represented by the general formula [II], [III], [IV] or [V];

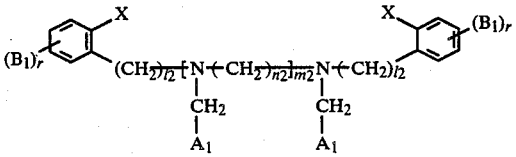

[II]

wherein $A_1$ is selected from the group consisting of a carboxylic acid group or a salt thereof and a phosphoric acid or a salt thereof; X is a hydroxy group or a group thereof; $B_1$ is selected from the group consisting of a halogen atom, a hydroxyl group or a salt thereof, an alkyl group, a carboxylic acid group or a salt thereof, a phosphonic acid group or a salt thereof; r and $l_2$ independently represent an integer of 0, 1 or 2; $n_2$ represents an integer of 1 to 4 and $m_2$ represents an integer of 0 to 3 provided that $l_2$, $m_2$ and $n_2$ are not 0 at the same time;

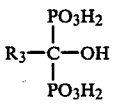

[III]

wherein, $R_3$ represents an amino group or a substituted or unsubstituted alkyl group having 1 to 5 carbon atoms or an amino group;

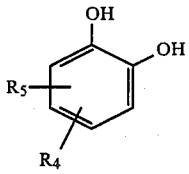

[IV]

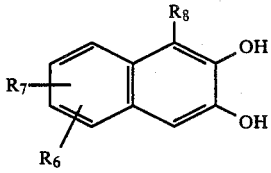

[V]

wherein, $R_4$, $R_5$, $R_6$, $R_7$ and $R_8$ are independently selected from the group consisting of a hydrogen atom, a halogen atom, a sulphonic acid group, a substituted or unsubstituted alkyl group having 1 to 7 carbon atoms, a substituted or unsubstituted phenyl group, $—OR_9$, $—COOR_{10}$, and

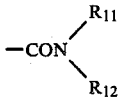

wherein, $R_9$, $R_{10}$, $R_{11}$ and $R_{12}$ are independently selected from the group consisting of hydrogen atom and an alkyl group having 1 to 18 carbon atoms.

9. The processing solution of claim 1, wherein said solution further comprises a compound represented by the general formula [VI] or [VII];

$$HO\text{-}(A)_{n3}(B)_{m3}H \quad [VI]$$

$$N[(A)_n(B)_mH]_3 \quad [VI]$$

wherein, n, m, A and B are respectively the same as defined in the formula [I] of claim 7, $n_3$ and $m_3$ respectively represent an integer of 0 to 600 provided that $n_3$ and $m_3$ are not 0 at the same time.

10. The processing solution of claim 1, wherein said solution is a replenishing solution substantially free of a bromide compound.

11. The processing solution of claim 7, wherein said solution contains a a compound of the formula [I] in an amount of 0.001 to 10 g per liter of said solution.

12. The processing solution of claim 7, wherein said solution contains a a compound of the compound [I] in an amount of 0.001 to 3 g per liter of said solution.

13. A method for processing a silver halide color photographic material comprising a step of processing said silver halide color photographic material with an effective amount of a developer solution comprising a color developing agent and at least one compound selected from the group consisting of an aminocarboxylic acid and an aminophosphonic acid, the developer solution having a surface tension ranging from 20 to 60 dynes/cm.

14. The method of claim 13, wherein said silver halide color photographic material further comprises a compound represented by the formula [D];

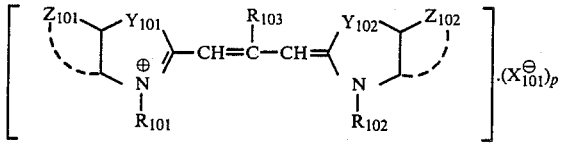

wherein $Y_{101}$ and $Y_{102}$ are independently selected from the group consisting of oxygen atom and sulfur atom; $Z_{101}$ and $Z_{102}$ independently represent a group of atoms necessary to complete a benzene ring or a naphthalene ring which is fused to an oxazole ring or a thiazole ring in the formula, in which a heterocyclic ring nucleus thus formed may have a substituent; $R_{101}$ and $R_{102}$ are radicals independently selected from the group consisting of an alkyl group, an alkenyl group and an aryl group, wherein said radical may be substituted; $R_{103}$ is selected from the group consisting of a hydrogen atom an alkyl group having 1 to 3 carbon atoms; $X_{101}$ is an anion; p is 0 or 1.

15. The method of claim 13, wherein said silver halide color photographic material contains an organic solvent having a dielectric constant of not less than 3.5.

16. The method of claim 15, wherein said organic solvent has a dielectric constant of 4.0 to 8.5 at 30° C.

17. The method of claim 13, wherein said organic solvent is represented by the general formula [S-I] or [S-II];

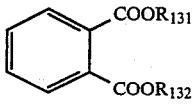

[S-I]

wherein $R_{131}$ and $R_{132}$ are radicals independently selected from the group consisting of an alkyl group and an aryl group, in which said groups may be substituted;

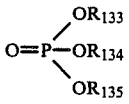

[S-II]

wherein $R_{133}$, $R_{133}$ and $R_{135}$ are independently selected from the group consisting of an alkyl group, an alkenyl group and an aryl group.

18. The method of claim 14, wherein said silver halide color photographic material contains a cyan dye-forming coupler represented by the formula (C-I), C-II) or (C-III) below;

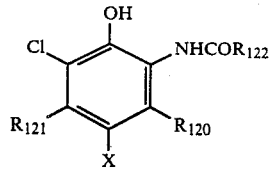

(C-I)

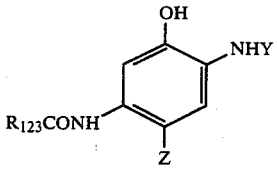

(C-II)

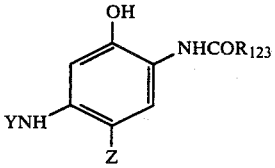

(C-III)

wherein one of $R_{120}$ and $R_{121}$ represents a hydrogen atom and the other represents a straight or branched alkyl group having 1 to 12 carbon atoms, X is a hydrogen atom or a substituent which is capable of being released upon coupling reaction with an oxidation product of a color developing agent and $R_{122}$ is a ballasting group; Y represents a group selected from

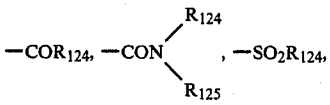

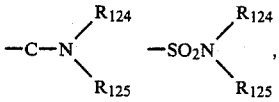

$-CONHCOR_{124}$ and $-CONHSO_2R_{124}$ (wherein $R_{124}$ is selected from the group consisting of an alkyl group an alkenyl group, a cycloalkyl group, an aryl group and a heterocyclic group, and $R_{125}$ is selected from the group consisting of a hydrogen atom, an alkyl group, alkenyl group, a cycloalkyl group, an aryl group and a heterocyclic group, provided that $R_{124}$ and $R_{125}$ may combine with each other to form a 5- or 6-membered heterocyclic ring); $R_{123}$ is a ballasting group and Z is a hydrogen atom or a substituent which is capable of being released upon coupling reaction with an oxidation product of a color developing agent.

* * * * *